US005543892A

United States Patent [19]

Hirata et al.

[11] Patent Number: 5,543,892

[45] Date of Patent: Aug. 6, 1996

[54] IMAGE FORMING APPARATUS CONNECTED TO AN INFORMATION MANAGEMENT APPARATUS THROUGH A COMMUNICATION LINE

[75] Inventors: Sumiaki Hirata, Aichi-ken; Ikunori Yamaguchi; Kazunobu Maekawa, both of Toyokawa, all of Japan

[73] Assignee: Minolta Camera Kabushiki Kaisha, Osaka, Japan

[21] Appl. No.: 197,259

[22] Filed: Feb. 16, 1994

[30] Foreign Application Priority Data

Feb. 16, 1993 [JP] Japan ..... 5-048804

[51] Int. Cl.[6] ..... G03G 21/00

[52] U.S. Cl. ..... 355/205; 355/313

[58] Field of Search ..... 355/205, 206, 355/207, 313, 314; 371/16.4; 379/100, 106

[56] References Cited

U.S. PATENT DOCUMENTS

| | | | |
|---|---|---|---|
| 3,893,175 | 7/1975 | Solomon | 355/202 |
| 3,997,873 | 12/1976 | Thornton | 340/149 R |
| 4,162,396 | 7/1979 | Howard et al. | 371/29.1 |
| 4,167,322 | 9/1979 | Yano et al. | 355/204 |
| 4,241,237 | 12/1980 | Paraskevakos et al. | 179/2 AM |
| 4,322,813 | 3/1982 | Howard et al. | 364/900 |
| 4,390,953 | 6/1983 | Johnstone | 364/474 |
| 4,398,819 | 8/1983 | Schron | 355/14 R |
| 4,495,596 | 1/1985 | Sciulli | 364/900 |
| 4,496,237 | 1/1985 | Schron | 355/14 C |
| 4,497,037 | 1/1985 | Kato et al. | 364/900 |
| 4,549,044 | 10/1985 | Durham | 179/5 R |
| 4,583,834 | 4/1986 | Seko et al. | 355/14 |
| 4,589,080 | 5/1986 | Abbott et al. | 355/208 |
| 4,739,366 | 4/1988 | Braswell et al. | 355/14 SH |
| 4,766,548 | 8/1988 | Cedrone et al. | 379/106 |
| 4,783,748 | 11/1988 | Swarztrauber et al. | 364/483 |
| 4,797,706 | 1/1989 | Sugishima et al. | 355/200 |
| 4,835,671 | 5/1989 | Sato et al. | 364/186 |
| 4,875,078 | 10/1989 | Resch, III et al. | 355/246 |
| 4,893,248 | 1/1990 | Pitts et al. | 379/106 |
| 4,996,703 | 2/1991 | Gray | 379/106 |
| 4,999,672 | 3/1991 | Rice, Jr. et al. | 355/202 |
| 5,021,826 | 6/1991 | Maruta | 355/205 |
| 5,023,817 | 6/1991 | Au et al. | 371/29.1 |
| 5,057,866 | 10/1991 | Hill, Jr. et al. | 355/200 |
| 5,077,581 | 12/1991 | Suzuki | 355/200 |
| 5,077,582 | 12/1991 | Kravette et al. | 355/206 |

(List continued on next page.)

FOREIGN PATENT DOCUMENTS

| | | |
|---|---|---|
| 59-142559 | 8/1984 | Japan . |
| 60-90460 | 5/1985 | Japan . |
| 61-178371 | 8/1986 | Japan . |
| 63-301667 | 12/1988 | Japan . |

OTHER PUBLICATIONS

"Remote Diagnostic—Tool Kit of the Future", Lynn S. Ritter, Research Newsletter, Datquest, pp. 1–6, 1989.

*Primary Examiner*—R. L. Moses
*Attorney, Agent, or Firm*—Burns, Doane, Swecker & Mathis

[57] ABSTRACT

A copying-machine management system for effecting centralized management of a plurality of copying machines in such a manner that data about problems developed during the maintenance of each copying machine is not counted as data about the problem occurring in each copying machine. A control CPU incorporated into a copying machine on the user side is electrically connected to a management CPU on the service station side through a communication line. Thus, a signal indicative of the state of the copying machine on the user side is sent to the management CPU on the service station, where each of the copying machines is managed. When a serviceman is sent to repair the copy machine, a serviceman mode is set. When the serviceman mode is set, the data indicating a problem is prohibited from being transmitted to the management CPU. Therefore, the data about a problem developed due to a reproduction test is not counted as the data about the problem occurring in each copying machine. Thus, since the data developed during the maintenance of each copying machine is not counted, each of the copying machines can be accurately managed.

11 Claims, 18 Drawing Sheets

U.S. PATENT DOCUMENTS

| | | | |
|---|---|---|---|
| 5,081,680 | 1/1992 | Bennett | 379/106 |
| 5,084,875 | 1/1992 | Weinberger et al. | 371/291 |
| 5,184,179 | 2/1993 | Tarr et al. | 355/206 |
| 5,214,772 | 5/1993 | Weinberger et al. | 395/575 |
| 5,216,461 | 6/1993 | Maekawa et al. | 355/202 |
| 5,220,380 | 6/1993 | Hirata et al. | 355/204 |
| 5,224,157 | 6/1993 | Yamada | 379/100 |
| 5,282,127 | 1/1994 | Mii | 355/206 X |
| 5,293,196 | 3/1994 | Kaneko et al. | 355/200 |
| 5,300,980 | 4/1994 | Maekawa et al. | 355/204 |
| 5,384,622 | 1/1995 | Hirata et al. | 355/206 |

Fig.5

| | | | | | | | |
|---|---|---|---|---|---|---|---|
| $b_7$ | $b_6$ | $b_5$ | $b_4$ | $b_3$ | $b_2$ | $b_1$ | $b_0$ |

PAPER DISCHARGE CODE $b_0=0$: DISCHARGE OF 1 COPY PAPER $b_7=1, b_6=0$: OCCURRENCE OF PAPER JAM $b_7=1, b_6=1$: OCCURRENCE OF PROBLEM

Fig.6

| MESSAGE NUMBER | MESSAGE |
|---|---|
| 1 | WAIT |
| 2 | COPY AVAILABLE |
| 3 | SUPPLY COPY PAPER |
| 4 | SUPPLY TONER |
| 31 | PROBLEM HAS OCCURRED |
| 32 | PROBLEM HAS OCCURRED. STATE OF PROBLEM WILL BE INFORMED TO THE SERVICE STATION AUTOMATICALLY |
| 33 | BEING ON-LINE WITH SERVICE STATION |
| 34 | SERVICEMAN IS EXPECTED TO ARRIVE AT ABOUT xx:xx HOURS,PLEASE WAIT |
| 35 | PROBLEM DATA CAN NOT BE AUTOMATICALLY SENT TO SERVICE STATION, CALL SERVICE STATION TELEPHONE NO.xxx-xxxx |

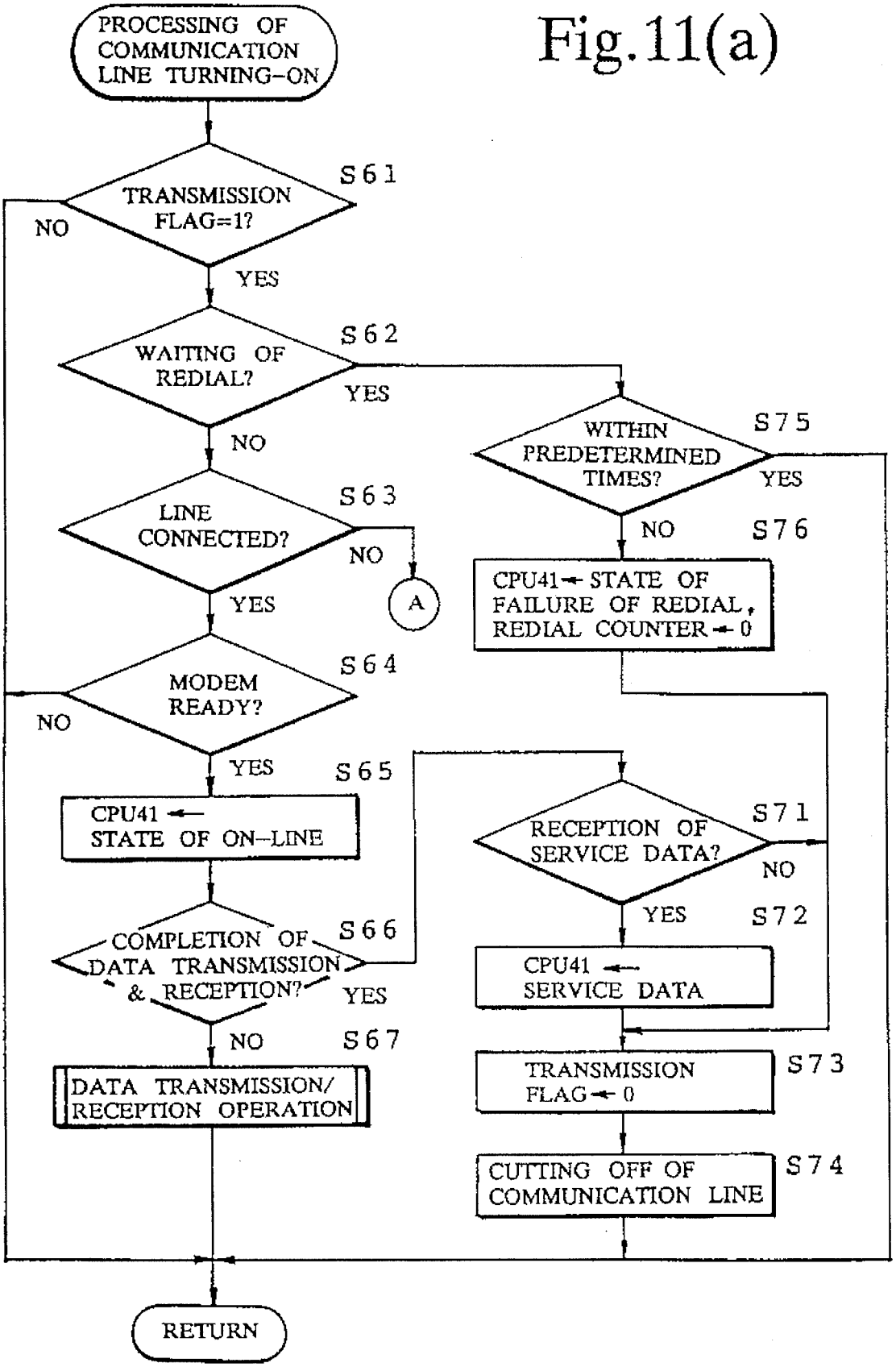
Fig.11(a)
PROCESSING OF COMMUNICATION LINE TURNING-ON
S61
TRANSMISSION FLAG=1?
NO
YES
S62
WAITING OF REDIAL?
YES
NO
S63
LINE CONNECTED?
NO
A
YES
S64
MODEM READY?
NO
YES
S65
CPU41 ← STATE OF ON-LINE
S66
COMPLETION OF DATA TRANSMISSION & RECEPTION?
YES
NO
S67
DATA TRANSMISSION/ RECEPTION OPERATION
S75
WITHIN PREDETERMINED TIMES?
YES
NO
S76
CPU41 ← STATE OF FAILURE OF REDIAL, REDIAL COUNTER ← 0
S71
RECEPTION OF SERVICE DATA?
NO
YES
S72
CPU41 ← SERVICE DATA
S73
TRANSMISSION FLAG ← 0
S74
CUTTING OFF OF COMMUNICATION LINE
RETURN PROCESSING OF PROBLEM TRANSMISSION PROHIBITING FLAG
PROBLEM TRANSMISSION PROHIBITING FLAG=0?
S221
NO
YES
TIMER HAS STARTED?
S222
YES
NO
S223
START OF PROBLEM TRANSMISSION PROHIBITING TIMER
TIMER COUNTED UP?
S224
NO
YES
S225
PROBLEM TRANSMISSION PROHIBITING FLAG ← 0
RETURN

IMAGE FORMING APPARATUS CONNECTED TO AN INFORMATION MANAGEMENT APPARATUS THROUGH A COMMUNICATION LINE

BACKGROUND OF THE INVENTION

1. Field of the Invention

The present invention relates to a system for managing copying machines and, more particularly to, a system for centralizing information about the state of each copying machine on an external management apparatus connected thereto through a communication line to thereby manage each of the copying machines.

2. Description of the Related Art

The maintenance and management of copying machines have heretofore been carried out by causing a serviceman to call on a user at regular intervals. Further, when a problem occurs in the copying machine, the maintenance service or work was effected by causing the serviceman to call on the user based on a phone connection or the like made by the user. It was therefore necessary to dispatch servicemen for the maintenance and management of each copying machine. Further, a lot of time was required to cope with the occurrence of the problem. To overcome such inconvenience, there has been proposed a management system wherein, in order to efficiently maintain and manage each copying machine, a copying machine provided on each user side is electrically connected to a management apparatus in a service station via a communication line so that the state of each copying machine provided on the user side is always monitored by the service station, thereby systematically and efficiently effecting the maintenance work (see Japanese Patent Laid-Open No. Sho 54-44522).

In this type of management system, when a problem occurs in one copying machine provided on the user side, the serviceman is immediately dispatched to solve the problem. When, at this time, the serviceman performs a test for reproducing the state of the problem to find the cause of the problem, the state of each of the problem occurring during that test are also sent to the management apparatus in the service station through the communication line, so that its state is inputted to a management recording file of a corresponding copying machine. That is, where the number of times at which problems have occurred for each month, is recorded in a management recording file, for example, even the problems occurring during the test are recorded as the number of times at which problem occurred. However, the problems caused during this test correspond to data not to be originally recorded. Thus, such troubles are apt to interfere with the accurate management of each copying machine. Further, the service station involves a possibility of inconvenience that it dispatches the serviceman to the user without knowing that the problems are those caused during the test.

SUMMARY OF THE INVENTION

A principal object of the present invention is to provide an improved copying-machine management system for centralizing information about the state of a plurality of copying machines on an external management apparatus electrically connected thereto through a communication line to thereby manage each of the copying machines.

Another object of the present invention is to provide an improved copying-machine management system wherein information about the state of each of the copying machines, which has been produced during the maintenance work on each copying machine, is not used as information for a management purpose of each copying machine.

A further object of the present invention is to provide an improved copying-machine management system for prohibiting information about a problem occurring in each of copying machines from being transmitted to an external management apparatus when a test mode is set to carry out the maintenance work of each copying machine.

The above and other objects, and novel features of the present invention will become apparent from the following detailed description and the appended claims, taken in conjunction with the accompanying drawings.

BRIEF DESCRIPTION OF THE DRAWINGS

FIG. 5 is a view for describing the combination of bits of data outputted from a CPU employed in the copying machine;

FIG. 6 is a view illustrating one example of display codes and messages displayed on the operation panel of the copying machine;

DETAILED DESCRIPTION OF THE PREFERRED EMBODIMENTS

Preferred embodiments of the present invention will hereinafter be described in detail with reference to the accompanying drawings.

Copying-Machine Management System

Figure 1:
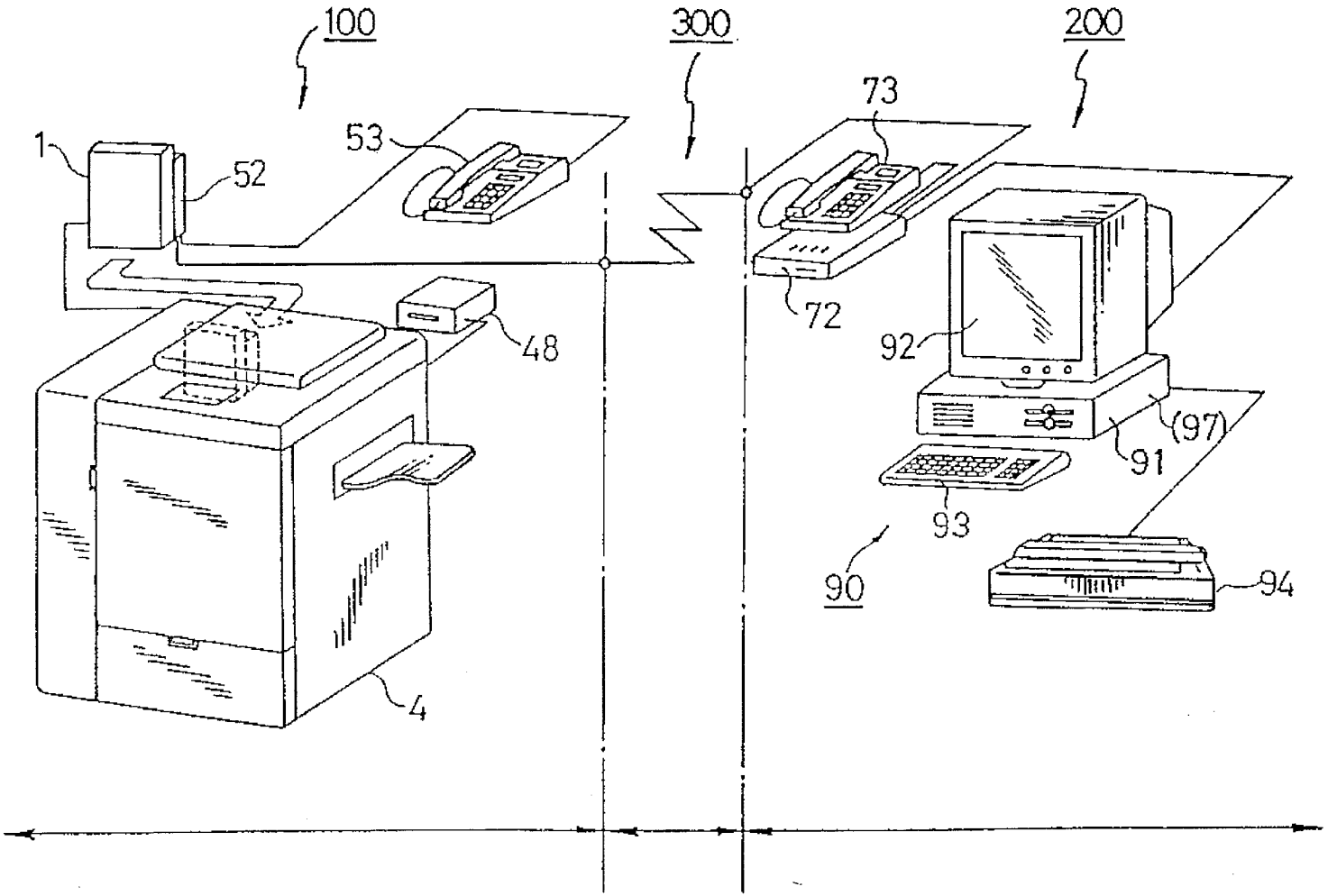
FIG. 1 is a view schematically illustrating the structure of a copying-machine management system.

A description will first be made of the structure of a copying-machine management system. FIG. 1 is a view schematically illustrating the structure of the copying-machine management system. The present copying-machine management system comprises an apparatus (which corresponds to an apparatus for one user or a number of users in FIG. 1) 100 on the user side, a management apparatus 200 provided in a service station, and a communication line 300 which provides an electrical connection between the apparatus 100 and the management apparatus 200.

The apparatus 100 on the user side is made up of a copying machine 4, a data terminal 1, a copy management apparatus 48 used to control copies for each department, a modem 52 which serves as a communication terminal, and a telephone set 53 which functions as a normal talking device.

The management apparatus 200 on the service station side is made up of a computer 90 comprising a modem 72 which functions as a communication terminal, a telephone set 73, a CPU 91 and a display 92, a keyboard 93, a printer 94, a RAM 97, etc.

The data terminal 1 is used as a device which receives as necessary various information such as a state of operation of the copying machine 4 electrically connected to the data terminal 1, etc. to thereby effect a predetermined process, draws up control or management data used for the copying machine 4, and transmits the data to the computer 90 of the management apparatus provided in the service station through the communication line 300. Incidentally, the transmission of the data to the service station side is carried out at any time upon occurrence of a problem as well as at regular intervals.

Further, the computer 90 on the service station side executes a process for controlling or managing the corresponding copying machine 4, based on management data transmitted from each of data terminals 1 of respective users. When problem information is inputted, for example, the computer 90 sends the time when a serviceman is to be dispatched and other information to a user's data terminal 1 and outputs an instruction given to a serviceman.

The respective devices or apparatuses referred to above will be described below.

Copying Machine

The copying machine 4 is a known electrophotographic copying machine. A description of the structure of an image forming mechanism will therefore be omitted herein. However, the copying machine has a group of sensors 46 (see FIG. 2), which are attached to various mechanisms related to the formation of an image in order to detect states of operation of the mechanisms. The group of sensors 46 may include a sensor for sensing the states of malfunctions or failures of the various mechanisms related to the formation of the image, for example, a sensor for sensing operating states such as a potential on the surface of a photosensitive drum, the density of toner in a developer, the amount of exposure of the photosensitive drum, a developing bias voltage, the amount of adhesion of toners on the photosensitive drum, and a grid voltage of a charger. Sensors may also be provided for sensing a burned-out exposure lamp, a disconnection of a fixing heater, an undesired discharge of a charge wire, for detecting the jamming of copying paper traveling on a conveying path and for detecting whether or not the jammed copying paper has been removed.

Figure 2:
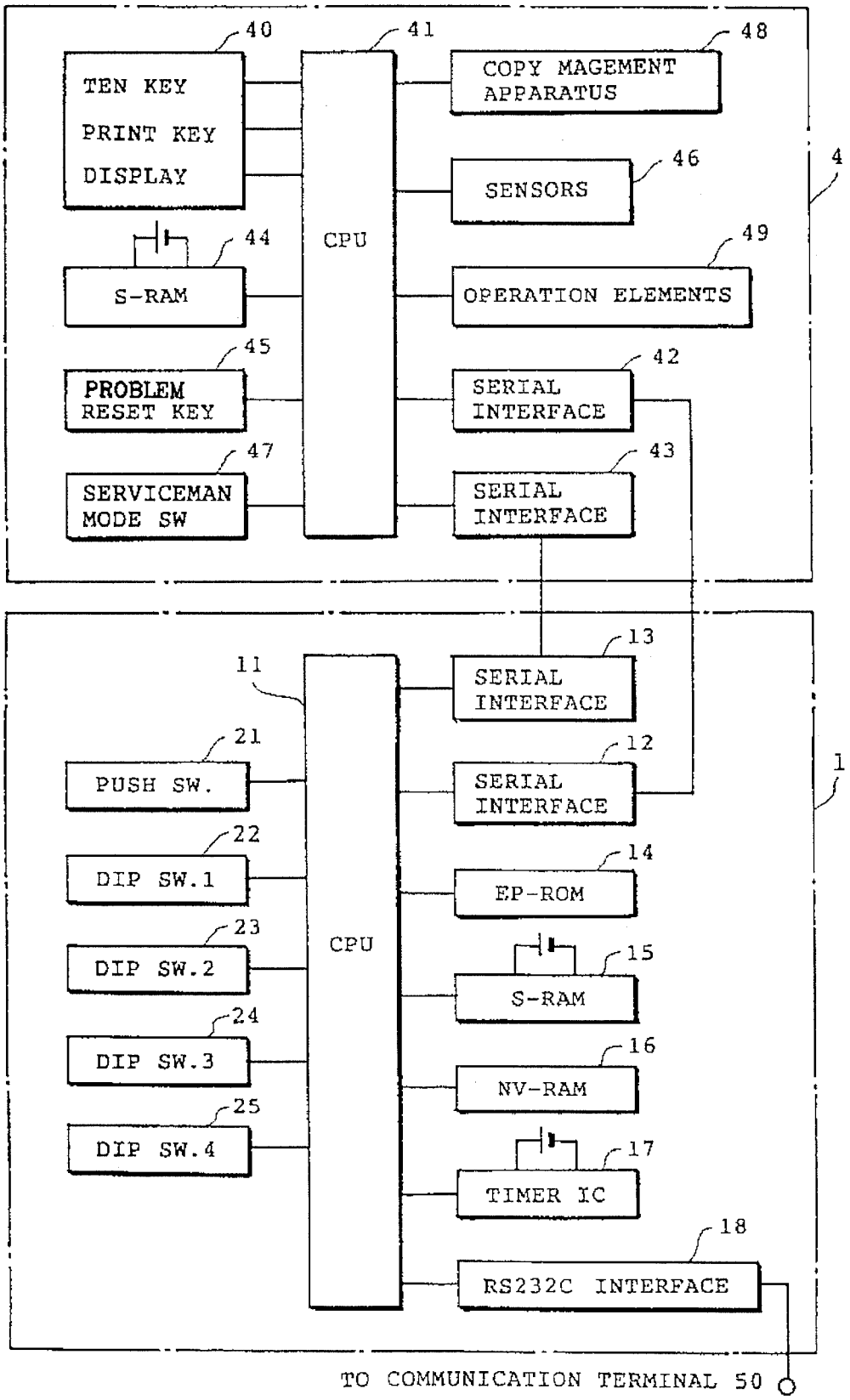
FIG. 2 is a block circuit diagram showing a control circuit and a data terminal both employed in a copying machine.

FIG. 2 is a block circuit diagram showing a control circuit of the copying machine 4 and a circuit of the data terminal 1. The control circuit of the copying machine 4 is made up of a CPU 41 used for the copying machine 4. Various key switches mounted on a control panel 40 (see FIG. 4) employed in the copying machine 4, such as a print key 401 for giving instructions about the initiation of a copying operation, a numerical input ten key 402, a clear/stop key 403 for clearing an input numerical value and stopping the copying operation, a function key group 404 and a message block 407*a*, a trouble reset key 45 provided externally from the control panel 40, a serviceman mode switch 47 which turns on when a serviceman card is inserted to thereby set a serviceman mode, a copy management apparatus 48, a static RAM 44, and serial interfaces 42, 43, and a group of various operation elements 49 of the copying machine 4, are electrically connected to an input/output port of the CPU 41.

Each of the plurality of signals indicative of the states of operations and malfunctions of the respective mechanisms, which have been detected by the sensor group 46 provided in the copying machine 4, is electrically processed by the CPU 41 and thereafter converted into a serial signal, which is in turn outputted to the data terminal 1 via the serial interface 43 and a serial interface 13 in that order.

Further, the plurality of signals inputted via the various key switches provided on the operation panel 40 are also electrically processed by the CPU 41, after which each so-processed signal is outputted to the data terminal 1 via the serial interface 42 and a serial interface 12 in that order.

Figure 4:
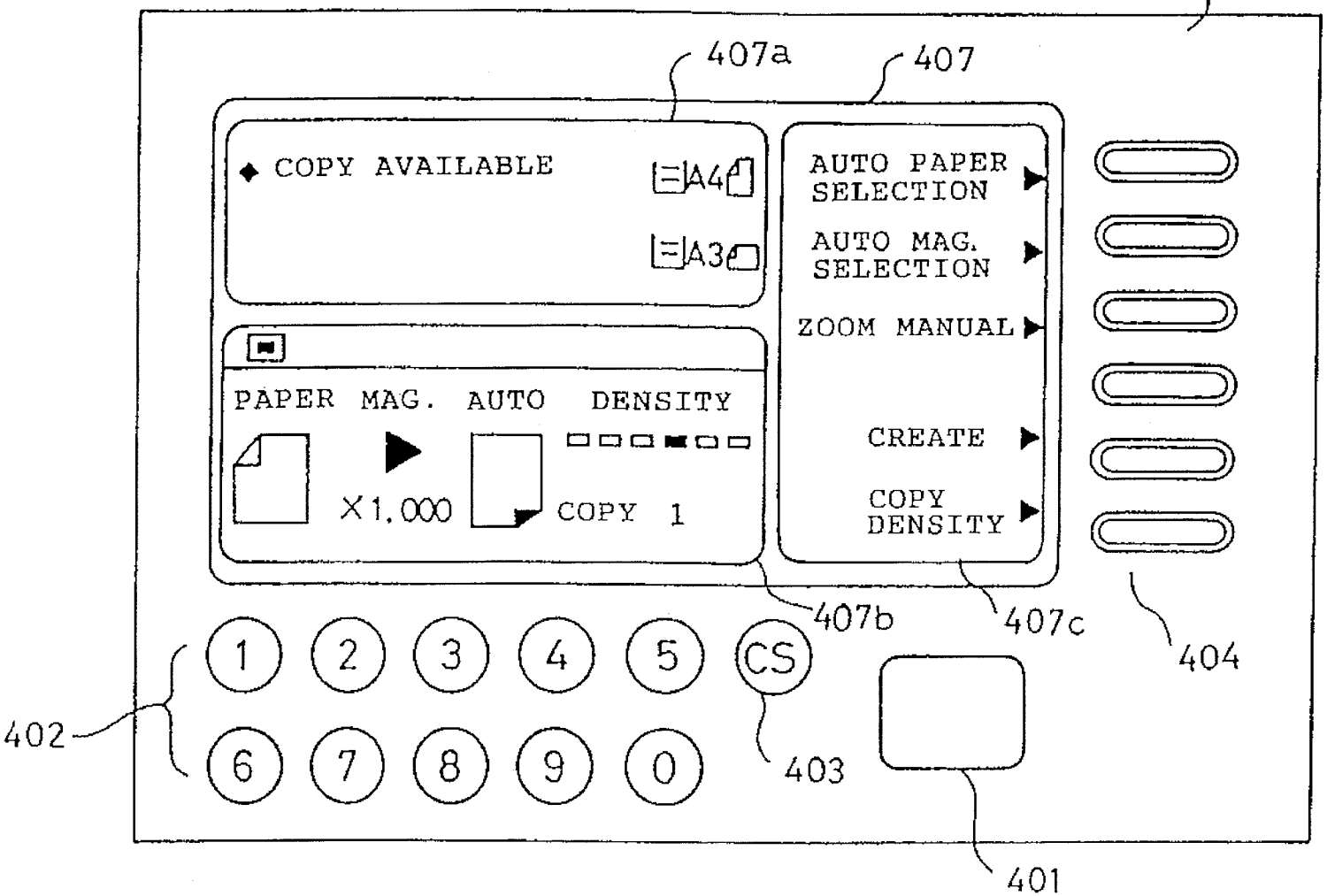
FIG. 4 is a plan view showing an operation panel of the copying machine.

The CPU 41 outputs a signal for driving an LCD graphic display panel 407 disposed on the operation panel 40 (see FIG. 4).

The graphic display panel 407 comprises the message block 407*a* for displaying thereon various states of the copying machine 4 such as the state of a failure to copy, the state of copying sheets being empty, and the state of toners being empty, a copying mode block 407*b* for displaying thereon conditions for a copying job, such as the number of sheets to be copied, the size of paper, the density of the original to be copied, and copying magnification, and a multi-function block 407*c* for setting automatic paper selection, automatic magnification selection, zoom magnification, creation, copying density, etc. under an interactive mode in accordance with operations combined with the function key group 404.

Various messages shown in FIG. 6 are displayed on the message block 407*a* according to the state of the copying machine 4. After the problem has occurred, the various messages subsequent to a message number 31 shown in FIG. 6 are displayed on the message block 407*a* depending on the conditions of communication of the modem 52 activated by the data terminal 1. The display of the messages on the message block 407*a* will be described in detail later.

Incidentally, the static RAM 44 electrically connected to the CPU 41 in the copying machine 4 stores the type (model) name and serial number of the copying machine 4 therein as data upon delivery of the copying machine 4 from its factory. Upon installation of the data terminal 1, these data are outputted to the CPU 11 of the data terminal 1 via the serial interfaces 42 and 12 according to a request sent from the CPU 11 of the data terminal 1. The various messages shown in FIG. 6 are also stored in the static RAM 44.

Data Terminal

Each of the data terminals 1 shown in FIGS. 1 and 2 receives and processes various signals indicative of the states of the copying machine 4, which are outputted from the CPU 41 electrically connected thereto. Further, the data terminal 1 edits control or management data. When predetermined sending or transmission conditions to be described later are met, the data terminal 1 activates the modem 52 (see FIGS. 1 and 3) so as to be connected with the management apparatus 200 in the service station through the corresponding communication line 300. Thereafter, the data terminal 1 serves to transmit the edited management data for the copying machine 4 to a CPU 91 of the management apparatus 200.

As is apparent from FIG. 2, the CPU 11 of the data terminal 1 is electrically connected to an EP-ROM 14 having control programs stored therein, a working static RAM 15 backed up by a battery, an NV-RAM 16 corresponding to a non-volatile memory having selection number data or the like to be described later stored therein, a timer IC 17 backed up by a battery, etc. Further, the CPU 11 of the data terminal 1 is also electrically connected to the CPU 41 in the copying machine via the serial interfaces 12 and 42 and the serial interfaces 13 and 43. Thus, data sent from the CPU 41 is also inputted to the CPU 11, where it is electrically processed. This processing will be described later.

As shown in FIG. 2, the CPU 11 of the data terminal 1 is electrically connected to a push switch 21 and dip switches 22 through 25. The push switch 21 is used to give or issue instructions for the initialization transmission or manual transmission. The dip switch 22 is used to set an input mode corresponding to a selection number (telephone number) of the service station. The dip switch 23 serves to set an input mode corresponding to an identification number (DTID) of the data terminal 1. The dip switch 24 is used to set an input mode corresponding to an identification number (STID) of a service station. Further, the dip switch 25 is used to set an initialization mode. These switches 20 through 25 are respectively located at suitable positions in the data terminal 1.

The management data sent to the CPU 91 of the management apparatus 200 from the CPU 11 of the data terminal 1 is decided depending on the kind of a transmission flag set to "1." Upon installation of the copying machine, for example, a manual transmission flag is set to "1" by a serviceman and identification data such as the type name and serial number of the copying machine is transmitted as an initially-set value. Further, when a fixed-time transmission flag is set to "1," management data indicative of the state of the copying machine, or the like is transmitted. When a problem transmission flag is set to "1" due to the occurrence of a problem, problem data indicative of the kind of problem or the like, and the like are transmitted.

The management data sent from the CPU 41 in the copying machine 4 to the CPU 91 of the management apparatus 200 via the CPU 11 of the data terminal 1 is made up of 8-bit data comprising bits b7 through b0 as shown in FIG. 5. That is, a take-off or discharge code indicative of the discharge of recording paper is represented by a change of a trailing edge from 1 to 0 of the bit b0. A JAM code indicative of an occurrence of a paper jam is represented by the bit b7 (=1) and the bit b6 (=0). A problem code indicative of the occurrence of each of the various problems is represented by the bit b7 (=1) and the bit b6 (=1).

Figure 3:
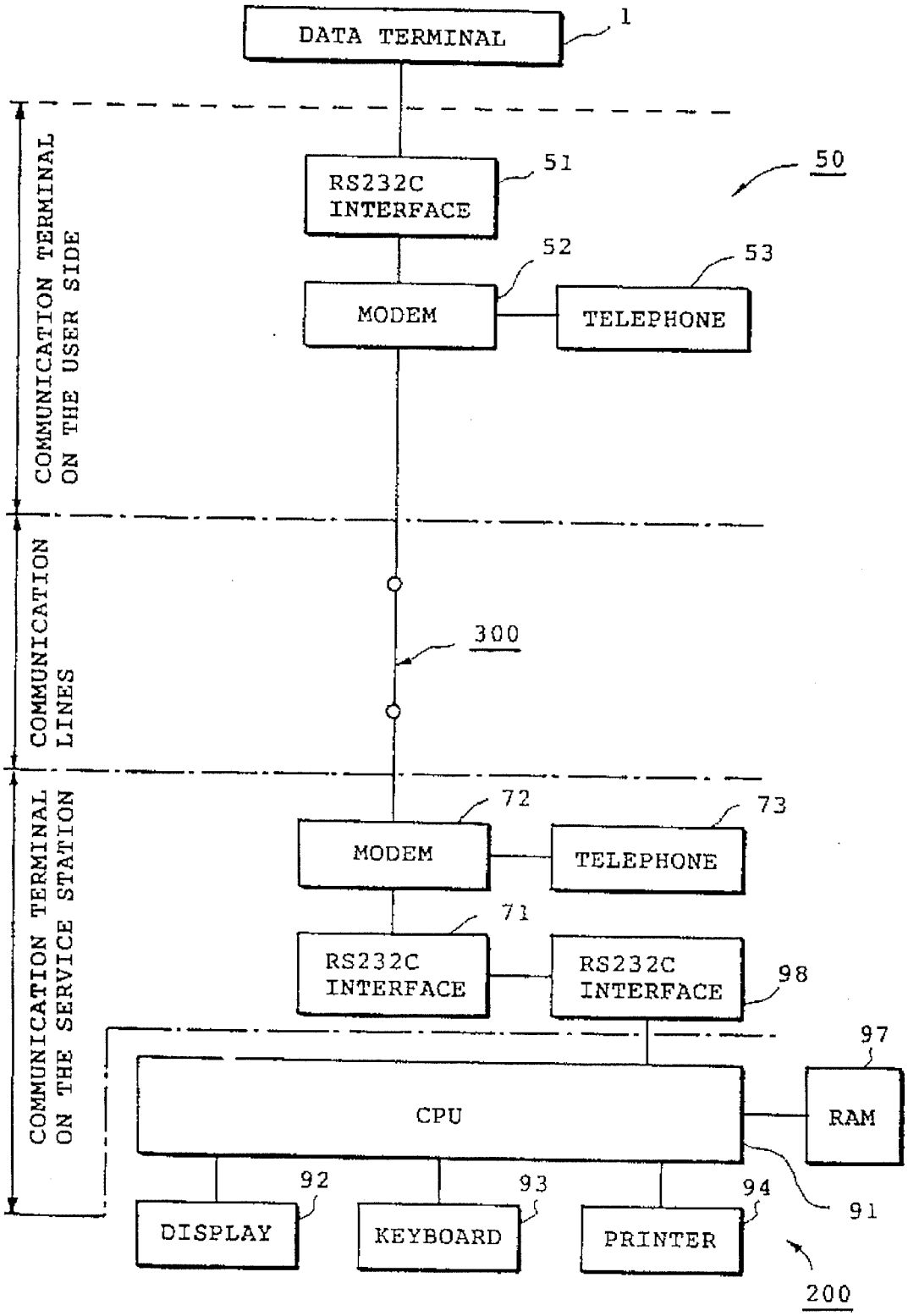
FIG. 3 is a block circuit diagram illustrating an electrical connection between a data terminal and a management apparatus.

FIG. 3 is a circuit diagram illustrating an electrical connection between the data terminal 1 and the management apparatus 200 in the service station. The data terminal 1 is electrically connected to the modem 52 serving as the communication terminal via a communication interface (RS232C) 18 (see FIG. 2) and a communication interface (RS232C) 51 of a communication terminal 50 on the user side. Further, the data terminal 1 is electrically connected to the modem 72 of the management apparatus 200 in the service station through the communication line 300.

Management Apparatus

The management apparatus 200 in the service station is a computer system comprised principally of the CPU 91 as shown in FIGS. 1 and 3, and is made up of the CPU 91 and the display 92, the keyboard 93, the printer 94, the RAM 97, etc.

Further, the modem 72, which functions as the communication terminal, is electrically connected to the CPU 91 of the management apparatus 200 via a communication interface (RS232C) 71 and a communication interface (RS232C) 98 of the CPU 91. The management data of the copying machine 4, which has been sent from the data terminal 1 of each user, is inputted to the CPU 91 of the management apparatus 200 via the modem 72, the communication interface (RS232C) 71 and the communication interface (RS232C) 98.

The management data sent from each copying machine 4 is electrically processed by the CPU 91 of the management apparatus 200 and a copying-machine management file, which has been drawn up into the RAM 97, is updated. That is, the identification data of the copying machine, which has been received upon its initialization, is compiled so as to be load into RAM 97 as a new copying-machine management file. At the end of the month, the amounts to be charged are calculated based on the management data to thereby print bills.

When the fixed-time communication is made, the management data is received so as to update the copying-machine management file. Further, the next time data to be transmitted on time and the next update password are sent to the corresponding data terminal 1. When problem data is received, a problem is recorded in the copying-machine management file as data. Further, the scheduled time for call of the serviceman is decided and then transmitted to the corresponding data terminal 1. Besides, instructions (such as the date and hour for call and parts to be taken with the serviceman) to be given to the serviceman are outputted.

Control of System

The control of the copying-machine management system will be described below in order of the process executed by the CPU 41 of the copying machine, the process executed by the CPU 11 of the data terminal 1 and the process executed by the CPU 91 of the management apparatus 200. Incidentally, the term "on edge" which will be used in the following description, indicates a state of a change of a switch, a sensor, a signal or the like from an off-condition to an on-condition. The term "off edge" indicates a state of a change of the switch, the sensor, the signal or the like from the on-condition to the off-condition.

Processes by CPU 41 of Copying Machine

The respective processes executed by the CPU 41 in the copying machine 4 will now be described with reference to flowcharts shown in FIGS. 7 and 8.

Figure 7:
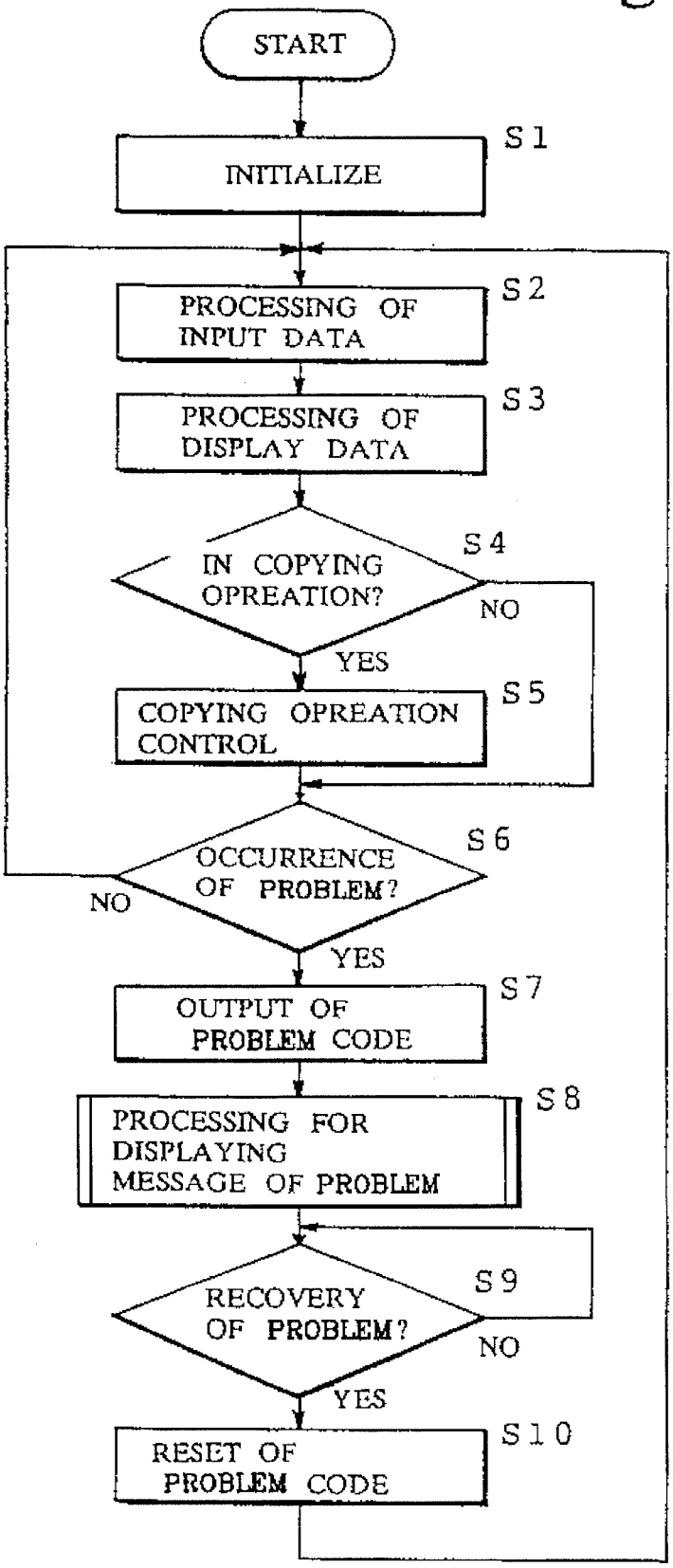
FIG. 7 is a flowchart for explaining the outline of a process executed by the CPU employed in the copying machine.
Figure 8:
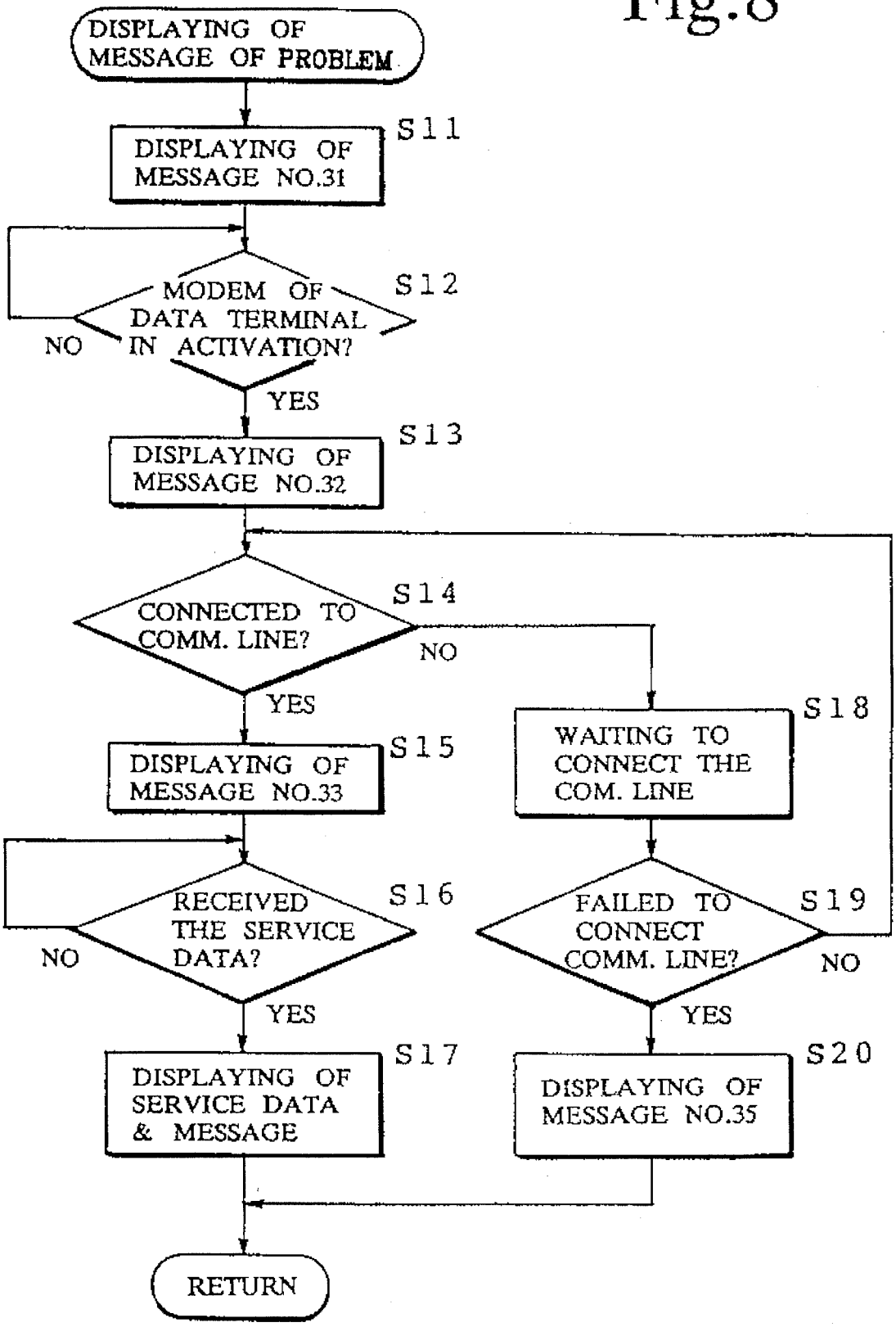
FIG. 8 is a flowchart for describing on-trouble problem displaying process executed by the CPU employed in the copying machine.

FIG. 7 is a flowchart for describing the outline of the process executed by the CPU 41. A program is first operated when a power source is turned on. Then, the initialization such as the clearing of a memory and the setting of a standard mode is carried out (Step S1).

Data input processes such as the input of signals from the key switches on the operation panel 40, the various switches disposed inside the copying machine and the group of various sensors, and the reception of data from the data terminal are executed (Step S2).

A process (excluding an on problem displaying process) for normally displaying information on the graphic display panel 400 provided on the control panel 40 is executed (Step S3).

It is then determined whether or not the copying machine 4 is in copying operation (Step S4). If the answer is affirmative in Step S4, processes necessary for copying operations, i.e., controls of a group of various operating parameters such as paper feeding control, scanning control, control for the photosensitive drum and control for a developing machine are executed (Step S5). If the answer is negative in Step S4, Step S5 is not executed.

It is determined based on the signals inputted from the group of various sensors 46 whether or not problems such as paper jamming, the burning-out of the exposure lamp and the fixing heater and improper discharge of the charge wire have occurred (Step S6). If the answer is affirmative in Step S6, a problem code signal corresponding to a developed problem is outputted to the corresponding data terminal 1 (Step S7). When the CPU 11 of the data terminal 1 receives the problem code signal, it transmits a signal or data indicative of the problem to the CPU 91 of the management apparatus 200, i.e., problem-data transmission is made to the CPU Further, a process for displaying a message indicative of the occurrence of the problem on the message block 407*a* of the graphic display panel 407 on the operation panel 40 is executed (Step S8). This process will be described in detail later.

The repairing of the problem by the serviceman and the like are next executed. It is thereafter determined whether or not the problem reset switch 45 has been turned on (Step S9). If the answer is affirmative in Step S9, the problem code is reset (Step S10). Thus, a problem reset signal is sent to the corresponding CPU 11 of the data terminal 1, which in turn effects problem recovery transmission on the CPU 91 of the management apparatus 200 in response to this signal. Further, the message display concerning the problem, which has been displayed on the message block 407*a* of the graphic display panel 407, is deleted and the screen is returned to a normal display screen.

If the answer is negative in Step S6, it is then unnecessary to carry out the process for displaying the message indicative of the occurrence of the problem, and hence, the routine procedure is immediately returned to Step S2.

The displaying process executed in Step S8 on the flowchart shown in FIG. 7 upon the occurrence of the problem will next be described in detail with reference to a flowchart shown in FIG. 8, and FIG. 6.

A message corresponding to a message No. 31, which is indicative of "Problem has occurred," is first displayed on the message block 407*a* of the graphic display panel 407 (Step S11). It is next determined whether or not the modem 52 is in an activated state (Step S12). If the answer is affirmative in Step S12, a message corresponding to a message No. 32, which is indicative of "Problem has occurred, and state of the problem will be transmitted to the service station automatically," is displayed on the message block 407*a* (Step S13).

It is determined whether or not the connection between the CPU 91 of the management apparatus in the service station and the corresponding communication line has been completed (Step S14). If the answer is affirmative in Step S14, a message corresponding to a message No. 33, which is indicative of "Being on-line with service station at present," is displayed on the message block 407*a* (Step S15).

It is determined whether or not service data such as the scheduled time for arrival of the serviceman has been received as the result of communication between the CPU 11 and the CPU 91 (Step S16). If the answer is affirmative in Step S16, a service data and message corresponding to a message No. 34, which is indicative of "Serviceman is expected to arrive at about xx:xx hours, and please wait," for example, is displayed (Step S17). Thereafter, the routine procedure is returned to a main routine.

On the other hand, when the connection between the CPU 91 and the communication line is not established even if a predetermined number of redialings are made, a predetermined time interval has elapsed (Steps S14, S18 and S19) and a signal indicative of non-connection therebetween is transmitted from the data terminal 1 (see Step S76 in FIG. 11), a message corresponding to a message No. 35, which is indicative of "Problem data cannot be automatically sent to service station, and hence make a service call by telephone number xxx-xxxx," is displayed (Step S20) and the routine procedure is returned to the main routine. Incidentally, the telephone number of the service station is set by the serviceman upon installation of each copying machine.

Processes by CPU 11 of Data Terminal

The summary of the respective processes executed by the CPU 11 of the data terminal will now be described with reference to a flowchart shown in FIG. 9. It is first determined whether or not an initial data setting mode has been established (Step S31). If the answer is affirmative in Step S31, an initial data setting process such as the reception of inputs such as the selection number (telephone number) of the service station, the identification number (DTID) of each data terminal and the identification number (STID) of the service station in accordance with the on or off state of dip switches 22 to 25 shown in FIG. 2, and the transmission of a signal indicative of the setting of initial data, is executed (Step S32). If the answer is negative in Step 31, the process of Step S32 is not carried out. Next, a copy operation permission signal is sent to the CPU 41 of the copying machine (Step S33).

In Step S34, a process for receiving various count data sent from the CPU 41 is executed. As the contents of the count data, there are mentioned a discharge code, a JAM code and a value counted by a JAM counter, a problem code and a value counted by a problem counter, a value counted for each paper size by a paper counter, a value counted by a PM counter, etc. These data are updated to the latest values and held in the CPU 11 of the data terminal.

In Step S35, a process for receiving data about respective elements forming each copying machine, which have been transmitted from the CPU 41 in the copying machine, and for bringing the data up to the latest values is executed.

In Step S36, a problem-data transmission deciding process for setting a problem transmission flag to 1 in response to a problem signal sent from the CPU 41 of the copying machine and setting a problem recovery transmission flag to 1 in response to a problem reset signal sent from the CPU 41, is executed. Incidentally, particulars of the problem-data transmission deciding process will be described in detail later. Thus, the problem-data transmission and the problem recovery transmission are executed with respect to the service station (see a communication line turning-on process, to be described later).

In Step S37, a fixed-time transmission deciding process for setting a fixed-time transmission flag to 1 at a predetermined time fixed for each data terminal is executed (see the communication line turning-on process to be described later). After the data transmission has been completed, data about the time of next fixed-time transmission, the present time, the time limit for each bill, etc. and an updated password are sent back from the service station.

In Step S38, the data about the various elements, the value counted by the JAM counter and the value counted by the PM counter are respectively compared with a predetermined threshold value. Thus, if each of these values does not fall within an allowable range, a warning transmission flag is set to 1 and a warning transmission deciding process are executed. If each of the values falls within the allowable range, a warning transmission process for setting a warning recovery transmission flag to 1 and a warning recovery transmission deciding process are executed. Thus, the transmission of a warning data transmission or a warning recovery data transmission is made (see the communication line turning-on process to be described later).

In Step S39, a manual transmission flag is set to 1 when the push switch 21 (corresponding to a switch used to issue the initial data setting mode or give an instruction for the manual transmission) is turned on in the case of non-initial data setting mode. As a result, the manual transmission is carried out (see the communication line turning-on process to be described later) and the data about the various elements are sent to the service station. Incidentally, the manual transmission is performed to inform the state of the copying machine at the starting of maintenance work or its completion to the management apparatus when the serviceman starts maintenance work or has finished its work.

In Step S40, a PM transmission deciding process for setting a PM transmission flag to 1 is executed when the PM counter is cleared due to the replacement of a part with another. Thus, PM transmission for transmitting the value prior to the clearing of the PM counter, whose counted value has been cleared to 0 due to the replacement of the part with another, to the service station is carried out.

In Step S41, a communication line turning-on process for activating the modem 52 when the transmission flag is set to 1 in any one of Steps S36 through S40 to thereby-electrically connect the CPU 11 of each data terminal to the CPU 91 of the management apparatus in the service station is executed. If the communication line turning-on process is executed, data communication corresponding to the set transmission flag is made between the CPU 11 of the data terminal and the CPU 91 of the management apparatus. As a result, the state of the data communication is sent to the CPU 41 in the copying machine. Particulars of the communication line turning-on process will be described in detail later.

In Step S42, a process about a problem transmission prohibiting flag is executed. This process will be described in detail later.

Figure 9:
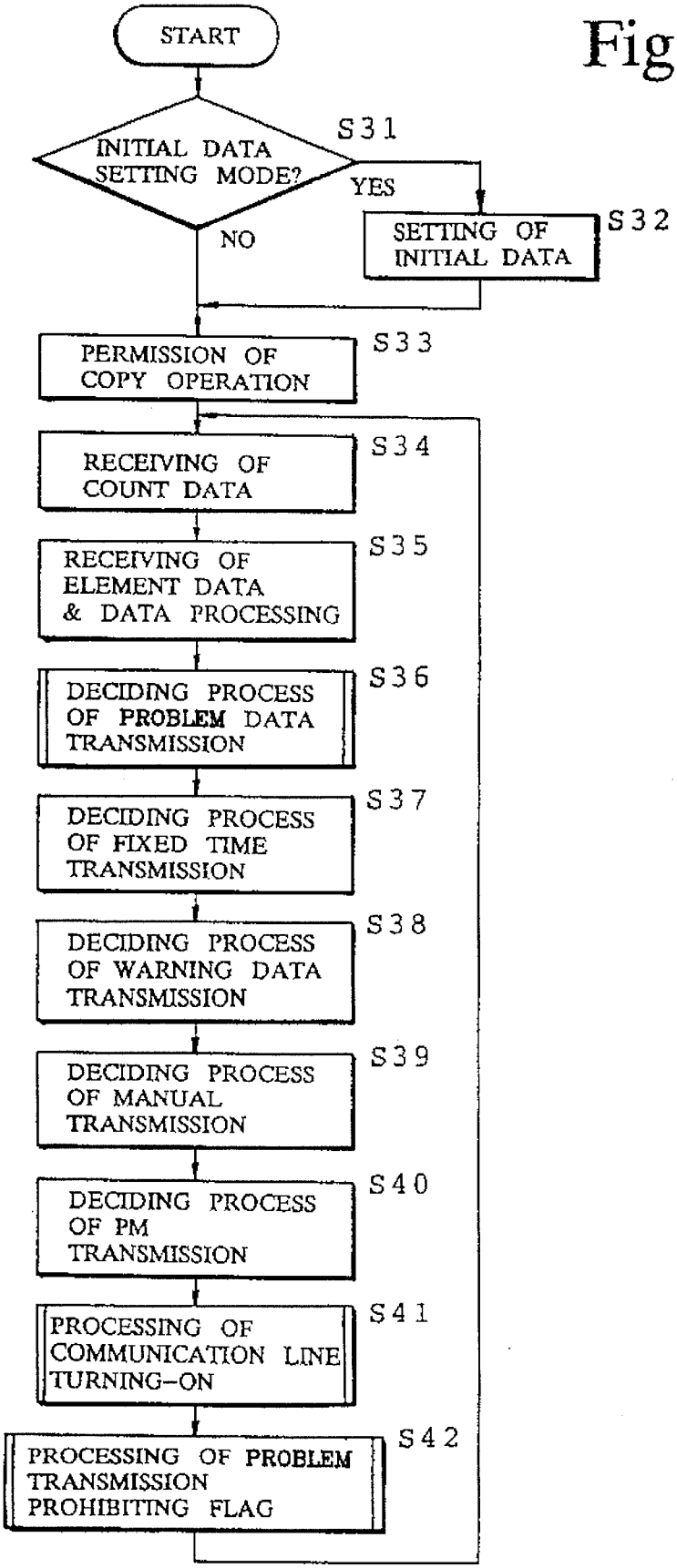
FIG. 9 is a flowchart for describing the outline of a process executed by a CPU employed in the data terminal shown in FIG. 2.
Figure 10:
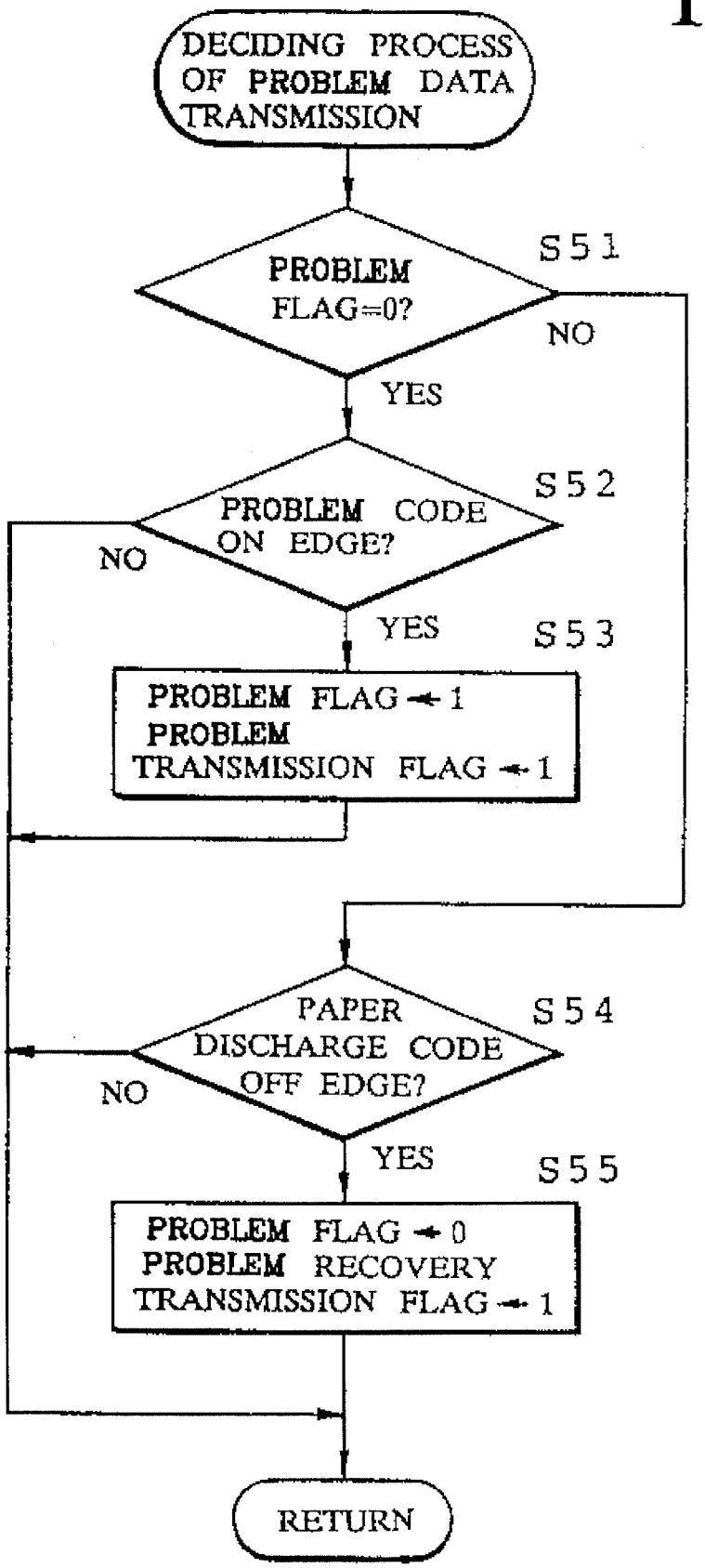
FIG. 10 is a flowchart for describing a problem-data transmission deciding process executed by the CPU shown in FIG. 9.

FIG. 10 is a flowchart for explaining particulars of the problem-data transmission deciding process executed in Step S36 on the flowchart of FIG. 9. When a problem occurs in a copying machine in a state of the problem flag=0 and an on-edge of a problem code signal is detected, it is decided that the problem has occurred. Thus, the problem flag is set to 1 and the problem transmission flag is set to 1 (Steps S51, S52 and S53).

When a paper discharge code sent from the copying machine is detected in a state of the problem flag=1, it is decided that the problem has been recovered. Thus, the problem flag is reset to 0 and the problem recovery transmission flag is set to 1 (Steps S51, S54 and S55).

Figure 11B:
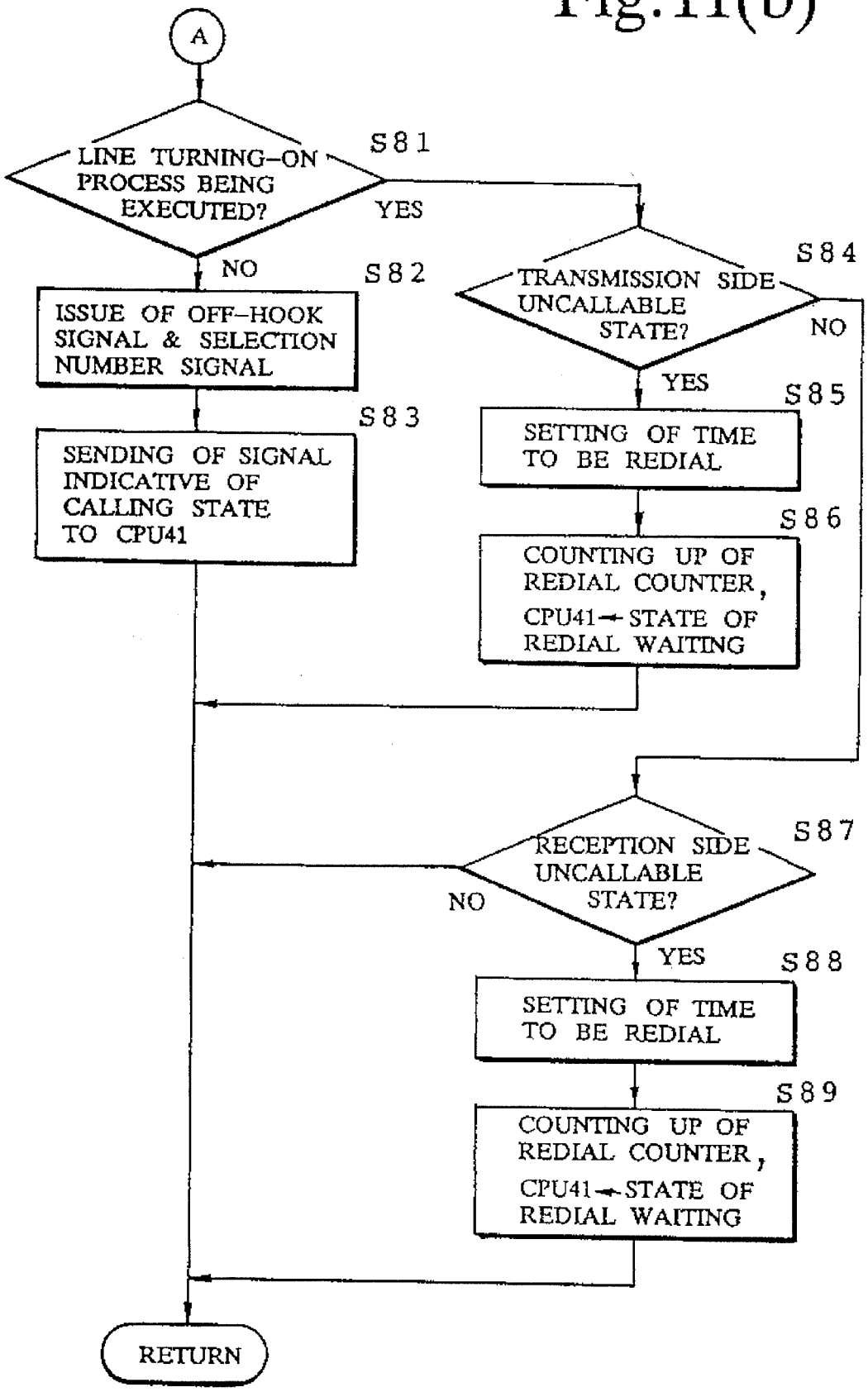
FIGS. 11(*a*) and 11(*b*) are flowcharts for describing a communication line turning-on process executed by the CPU of the data terminal.

FIGS. 11(*a*) and 11(*b*) are flowcharts describing the particulars of the communication line turning-on process executed in Step S41 on the flowchart of FIG. 9.

The communication line turning-on process is carried out in the following manner. That is, any one of the transmission flags is set to 1 so as to start the modem 52, thereby connecting the CPU 91 of the management apparatus in the service station to the corresponding communication line. After the connection between the CPU 91 and the communication line has been established, data corresponding to the set transmission flag is sent to the service station. When the problem-data transmission is made, service data is received from the service station. When the fixed-time transmission is made, a new password or the like is received from the service station.

It is first determined whether or not any one of the transmission flags has been set to 1 (Step S61). When the transmission flag is set to 1, it is determined whether or not a telephone set or modem is being placed in a redial waiting state (Step S62). If the answer is negative in Step S62, it is then determined whether or not the communication line is being connected to the service station (Step S63).

If the answer is negative in Step S63, the routine procedure proceeds to Step S81 (the flowchart shown in FIG. 11(*b*)), where it is determined whether or not the communication line turning-on process is being executed (Step S81). If the answer is negative in Step S81, that is, if the modem 52 is not placed in a waiting state after it has made a call instruction to the modem 72 on the service station side, an instruction for sending an off-hook signal and a selection number signal to the CPU 41 is issued to call the modem 72 on the service station side (Step S82). Further, a signal indicative of the fact that the modem 72 is being placed in a called state is sent to the CPU 41 of the copying machine (Step S83) and the routine procedure is returned to the main routine.

If the answer is affirmative in Step S81, it is then determined whether or not the telephone set 53 on the transmission side, Which has been connected to the modem 52, in use and the modem 72 on the service station side is in an uncallable state (Step S84). If it is decided in Step S84 that the telephone set 53 is in use, the time to be redialed is set after a predetermined time interval has elapsed (Step S85). Further, a redial counter is counted up and a signal indicative of the fact that the telephone set or modem is placed in the redial waiting state is sent to the CPU 41 of the copying machine (Step S86). Thereafter, the routine procedure is returned to the main routine.

If it is decided in Step S84 that the telephone set 53 on the transmission side is not in use, it is then determined whether or not the telephone set 73 on the reception side, which has been connected to the modem 72 on the service station side, is being used (i.e., there is involved a case in which a response signal is not outputted from the CPU 91 even if the modem 72 is in a connected state) (Step S87). If the answer is negative in Step S87, the routine procedure is returned to the main routine. On the other hand, if the answer is affirmative in Step S87, the redial time is set after the predetermined time interval has elapsed in a manner similar to the transmission side (Step S88). Further, the redial counter is counted up and the signal indicative of the fact that the telephone set or modem is being placed in the redial waiting state is sent to the CPU 41 of the copying machine (Step S89). After that, the routine procedure is returned to the main routine.

It is decided in Step S62 based on the above processing that the modem is placed in the redial waiting state (i.e., it is decided that the answer is affirmative). Thus, Step S82 for issuing the instruction for sending the off-hook signal and the selection number signal to the CPU 41 is not executed until the redial time. At the redial time, Step S82 is executed again to thereby make the instruction for sending the off-hook signal and the selection number signal to the CPU 41.

If the answer is affirmative in Step S62, it is then determined whether or not a value counted by the redial counter falls within a predetermined number of times (Step S75). If the answer is negative in Step S75, a redial failure signal indicative of the fact that the data terminal is being disconnected from the service station is sent to the CPU 41 of the copying machine to thereby reset the redial counter (Step S76). Further, the transmission flag is reset and the communication line is cut off (Steps S73 and S74).

If the answer is affirmative in Step S63, it is then determined whether or not data can be transmitted from the modem 72 on the service station side (i.e., the modem is ready) (Step S64). If the answer is negative in Step S64, the routine procedure is returned to the main routine. On the other hand, if it is decided in Step S64 that the modem 72 is ready, a signal indicative of the fact that the data terminal is connected with the service station is sent to the CPU 41 of the copying machine (Step S65).

It is next determined whether or not data corresponding to the transmission flag set to 1 has been transmitted to and received from the service station (Step S66). If the answer is negative in Step S66, the transmission and reception of the data to and from the service station are executed (Step S67) and the routine procedure is returned to the main routine. The detailed description will be made later.

If the answer is affirmative in Step S66, it is then determined whether or not service data has been received from the service station (Step S71). If the answer is affirmative in Step S71, the received service data is transmitted to the CPU 41 of the copying machine (Step S72). If the answer is negative in Step S71, Step S72 is not executed. Since the transmission of the data to the CPU 41 and the reception of the data from the service station are completed in the above-described manner, the transmission flag is reset and the communication line is cut off (Steps S73 and S74).

Figure 12:
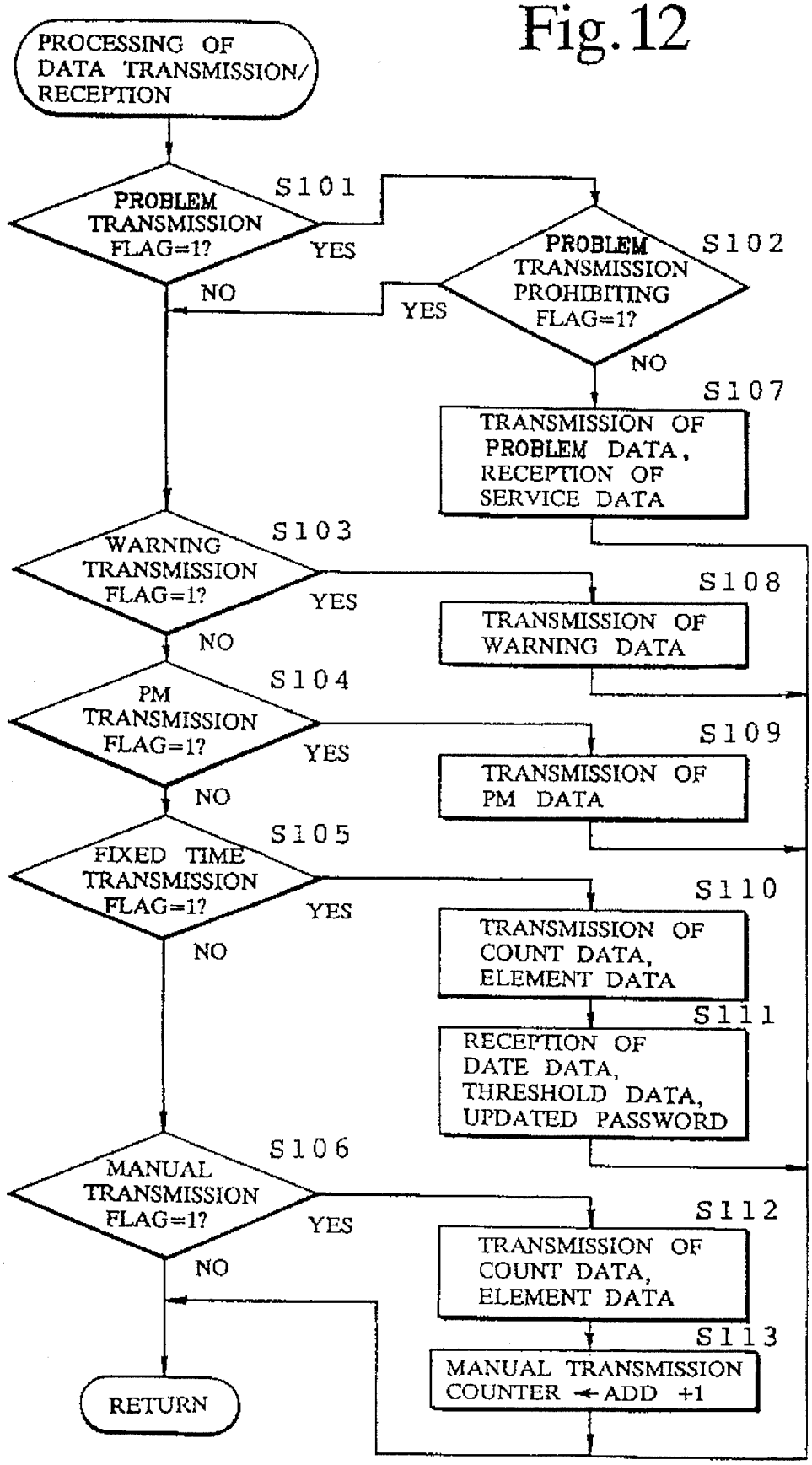
FIG. 12 is a flowchart for describing a data transmission/reception process taken during the communication line turning-on process executed by the CPU of the data terminal.

FIG. 12 is a flowchart for describing, in detail, the data transmission/reception process executed in Step S67 on the flowchart shown in FIG. 11(*a*).

It is first determined whether or not a problem has occurred in a copying machine and a problem transmission flag has been set to 1 (Step S101). If the problem transmission flag is 1, it is then determined whether or not a problem transmission prohibiting flag is 1 (Step S102). If the answer is negative in Step S102, problem data is transmitted and service data is received (Step S107) and the routine procedure is returned to a main routine.

If it is decided based on the result of decision in Step S101 that the problem transmission flag is not 1 and it is decided based on the result of decision in Step S102 that the problem transmission prohibiting flag is 1, a warning transmission flag, a PM transmission flag, a fixed-time transmission flag and a manual transmission flag are successively decided (Steps S103, S104, S105 and S106).

If the warning transmission flag is found to be 1 from the result of decision referred to above, warning data is transmitted (Step S108). If the PM transmission flag is found to be 1, PM data is transmitted (Step S109). If the fixed-time transmission flag is found to be 1, various count data and element data are transmitted (Step S110). Further, the date and hour to be used for transmission and a threshold data are received and an updated password is received (Step S111). If the manual transmission flag is found to be 1, the various count data and the element data are transmitted (Step S112). Further, the manual transmission counter is incremented by 1 (Step S113) and the routine procedure is returned to the main routine.

Figure 13:
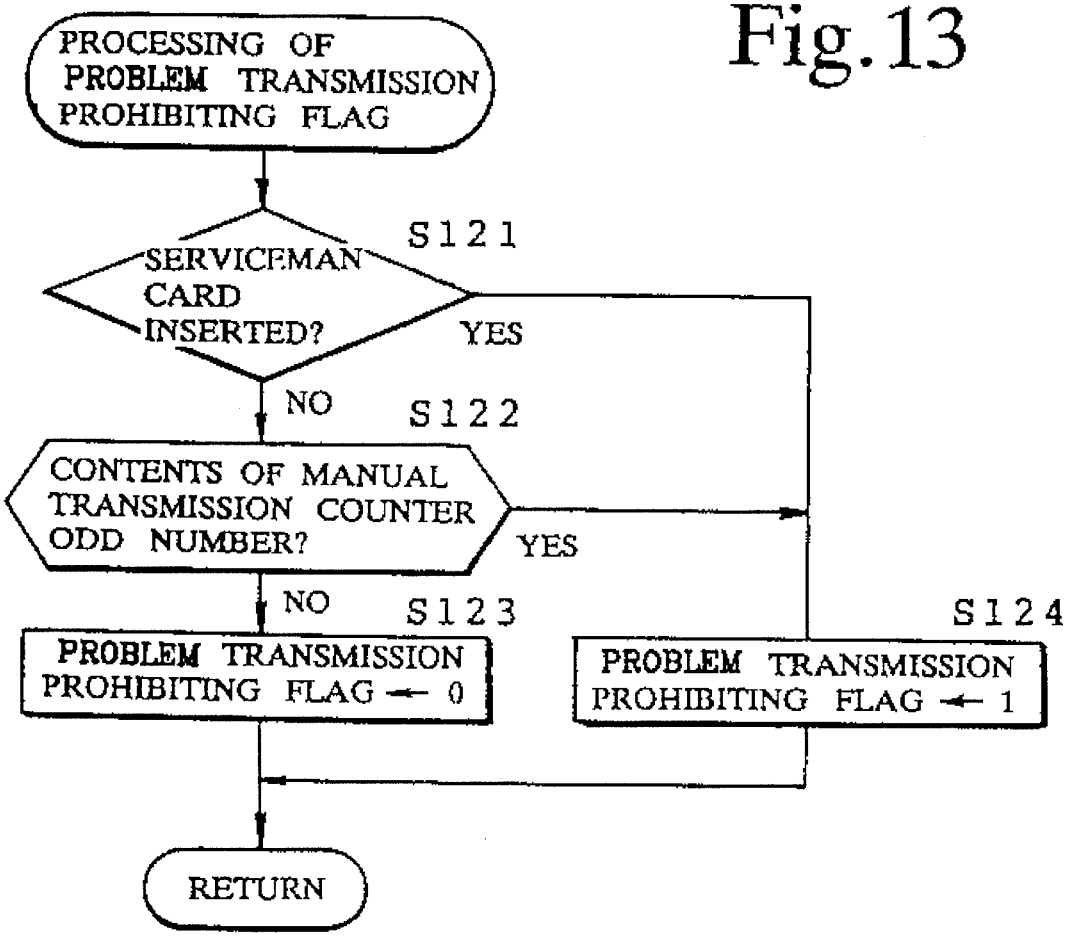
FIG. 13 is a flowchart for describing a problem transmission prohibiting flag process executed by the CPU of the data terminal.

FIG. 13 is a flowchart for describing, in detail, the processing of the problem transmission prohibiting flag, which has been executed in Step S42 of the flowchart of FIG. 9.

When a serviceman performs his services such as repair of a problem occurring in a copying machine, the serviceman carries out a problem reproduction test to make a diagnosis of the state of the problem. At this time, however, the problem-data transmission is automatically effected on the service station to diagnose the reproduced problem. Since, however, the state of the problem is diagnosed in this case, it is unnecessary to carry out the problem-data transmission. Further, the control data for the service station is updated unnecessarily. Therefore, when the repair of the problem and the like are carried out, the serviceman card is inserted into the copying machine 4 to turn on the serviceman mode switch 47, thereby setting the serviceman mode so as to prohibit the problem-data transmission.

The processing of the problem transmission prohibiting flag will be described below with reference to the flowchart shown in FIG. 13. It is first determined based on an on-signal for the serviceman mode switch 47 whether or not the serviceman card has been inserted into the copying machine 4 (Step S121). If the answer is affirmative in Step S121, the problem transmission prohibiting flag is set to 1 and the serviceman mode is established (Step S124).

If the answer is negative in Step S121, it is then determined whether or not the contents of the manual transmission counter is an odd number (Step S122). If the answer is affirmative in Step S122, the problem transmission prohibiting flag is set to 1 (Step S124). If the answer is negative in Step S122, the problem transmission prohibiting flag is reset to 0 (Step S123) and the routine procedure is returned to the main routine. When the manual transmission is carried out, the manual transmission counter is incremented by "+1" as is apparent by reference to Step S113 on the flowchart shown in FIG. 12.

According to the above processing, when the serviceman card is first inserted into the copying machine 4 upon starting the serviceman's work, the problem transmission prohibiting flag is set to 1. When the manual transmission is performed to exhibit the commencement of the serviceman's work in this state, the manual transmission counter is incremented by "+1" and hence the contents of the manual transmission counter is brought to an odd number. Further, when the manual transmission is carried out to exhibit the fact that the work of the serviceman has been completed, the manual transmission counter is incremented "+1" and hence the contents thereof is brought to an even number. Thus, the problem transmission prohibiting flag is reset to 0 so as to return to an initial state.

As an alternative to the case where the serviceman card is inserted into the copying machine as described above to prohibit the problem-data transmission to thereby set the serviceman mode, a manually-operated serviceman mode setting switch may be provided before the serviceman starts working. Further, the problem-data transmission may be prohibited when an identification number or the like is inputted via a ten key.

In the present embodiment, the problem data is prohibited from transmission on the copying machine side. However, data about a problem developed under a serviceman mode may be prohibited from counting on the management apparatus side in a service station.

Processes by CPU 91 of Management Apparatus

Figure 14:
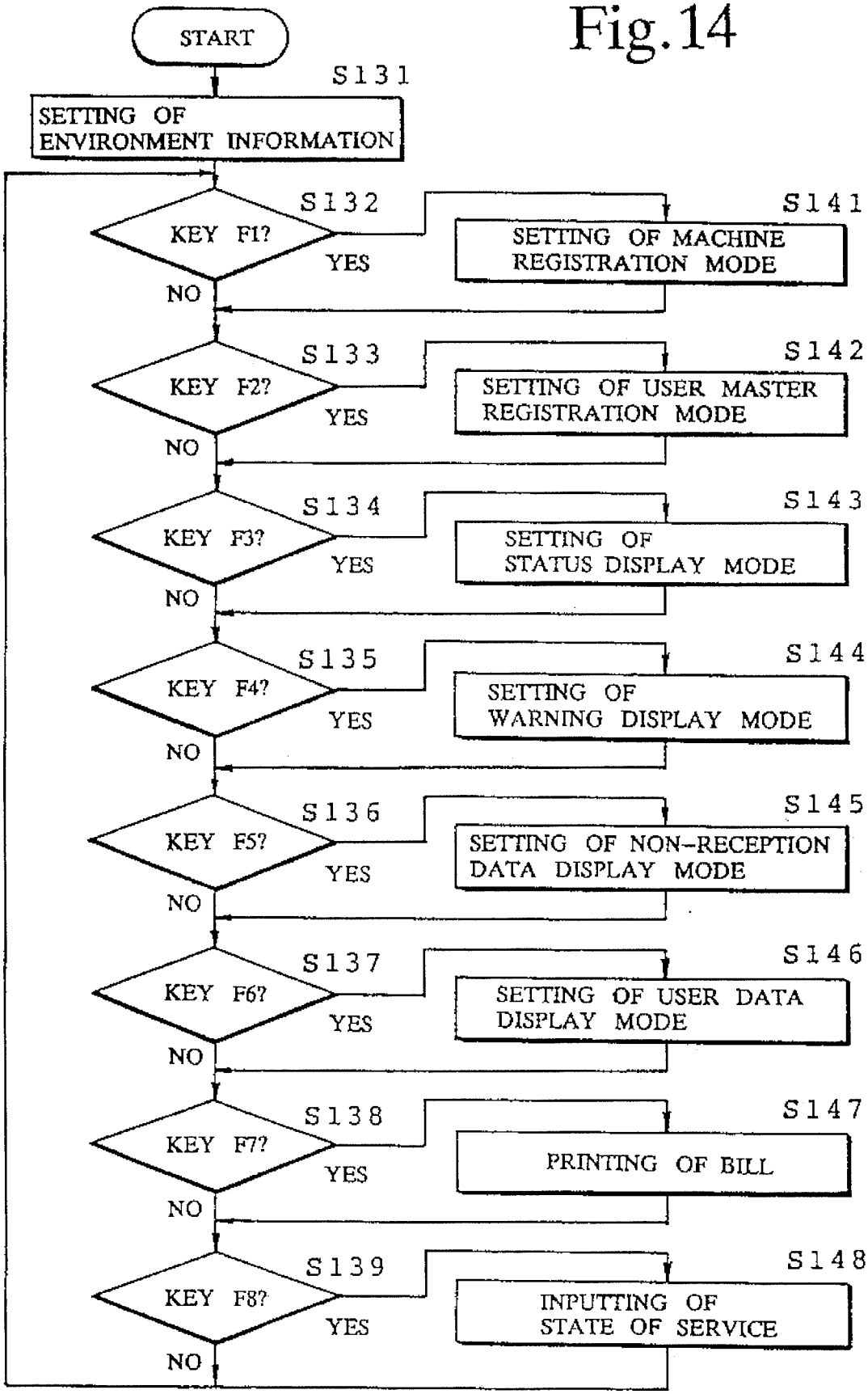
FIG. 14 is a flowchart for describing the outline of a process executed by a CPU of the management apparatus.

The processes executed by the CPU 91 of the management apparatus in the service station will now be described in accordance with a flowchart shown in FIG. 14. The CPU 91 starts operating due to the turning-on of a power supply. A check is first made as to the state of connection between peripheral devices such as the modem 72, the display 92, the keyboard 93 and the printer 94. Further, environmental information about the peripheral devices of the CPU 91 is set (Step S131).

Next, modes, which will be described below, are set according to input operations effected via respective switches of function keys F1 through F8 on the keyboard 93. Alternatively, processes, which will be described below, are executed.

If it is decided that the function key F1 has been selected and operated (Step S132), a machine registration mode is set (Step S141). That is, a reception for newly registering the name of type, the number of items of element data, the designation of each element data, a standard threshold value for each element data, a standard threshold value for each counter, etc. is carried out.

If it is decided that the function key F2 has been selected and operated (Step S133), a user master registration mode is set (Step S142). That is, a reception for newly registering the name, address and telephone number of each user, the name of type, the number of machine, the date and hour to be used upon on-time transmission, etc. is performed. Further, an identification number DTID for each data terminal is automatically set.

If it is decided that the function key F3 has been selected and operated (Step S134), a problem status display mode is created (Step S143). That is, user information (name, address and phone number of each user, name of type) for a copying machine in which a problem-data transmission has been performed, the date and hour of occurrence of a problem, the number of times at which the problem has occurred, etc. are displayed on the display 92 together with the contents of the problem.

Incidentally, the number of problems is always displayed at the corner of the display 92 regardless of the operation of the function key F3. Further, the state of each problem is displayed even during communication of the problem-data transmission as will be described later (see Step S162 in FIG. 16).

If it is decided that the function key F4 has been selected and operated (Step S135), a warning display mode is set (Step S144). That is, user information for a copying machine in which the warning transmission has been performed and the like are displayed on the display 92 together with the contents of a warning. Incidentally, the number of warnings is always displayed at the corner of the display 92 regardless of the operation of the function key F4.

If it is decided that the function key F5 has been selected and operated (Step S136), a non-reception data display mode is set (Step S145). That is, user information for a copying machine, in which the fixed-time transmission is not carried out even when the predetermined time for fixed-time transmission has elapsed, is displayed on the display 92. Incidentally, the number of non-receptions data is always displayed at the corner of the display 92 irrespective of the operation of the function key F5.

If it is decided that the function key F6 has been selected and operated (Step S137), a user data display mode is set. When a user is specified, corresponding user information is displayed (Step S146). When a submenu is selected, values counted by various counters (such as a total counter, a paper by-size counter, a JAM counter, a problem counter and a PM counter) employed in each copying machine of a corresponding user, and element data are displayed for each month or item.

If it is decided that the function key F7 has been selected and operated (Step S138), a bill is printed out (Step S147). A printer is started to print out the claimed amount, which has been calculated based on the counted value of the total counter and a predetermined calculating expression.

If it is decided that the function key F8 has been selected and operated (Step S139), the state of service is input and accepted (Step S148). That is, data about the creation of service schedules such as a schedule for a serviceman and a supply/stock of parts are and accepted. The input various data input are edited so as to produce service-schedule management data by the CPU 91 of the management apparatus. Thereafter, the produced management data are stored in the RAM 97.

Figure 15:
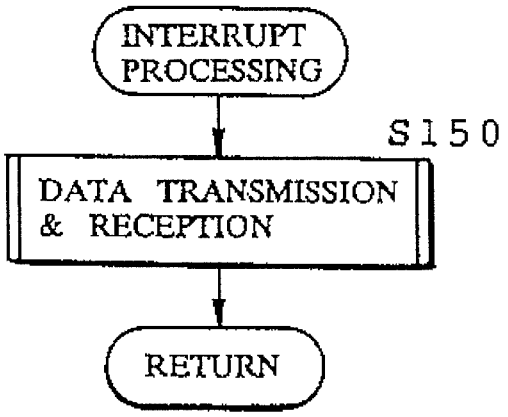
FIG. 15 is a flowchart for describing an interrupt process executed by the CPU of the management apparatus.

FIG. 15 is a flowchart for describing an interrupt process executed by the CPU 91 of the management apparatus in the service station. According to the flowchart shown in FIG. 15, the transmission and reception of data between the service station and the data terminal 1, and its process are executed in the form of the interrupt process (Step S150).

Figure 16:
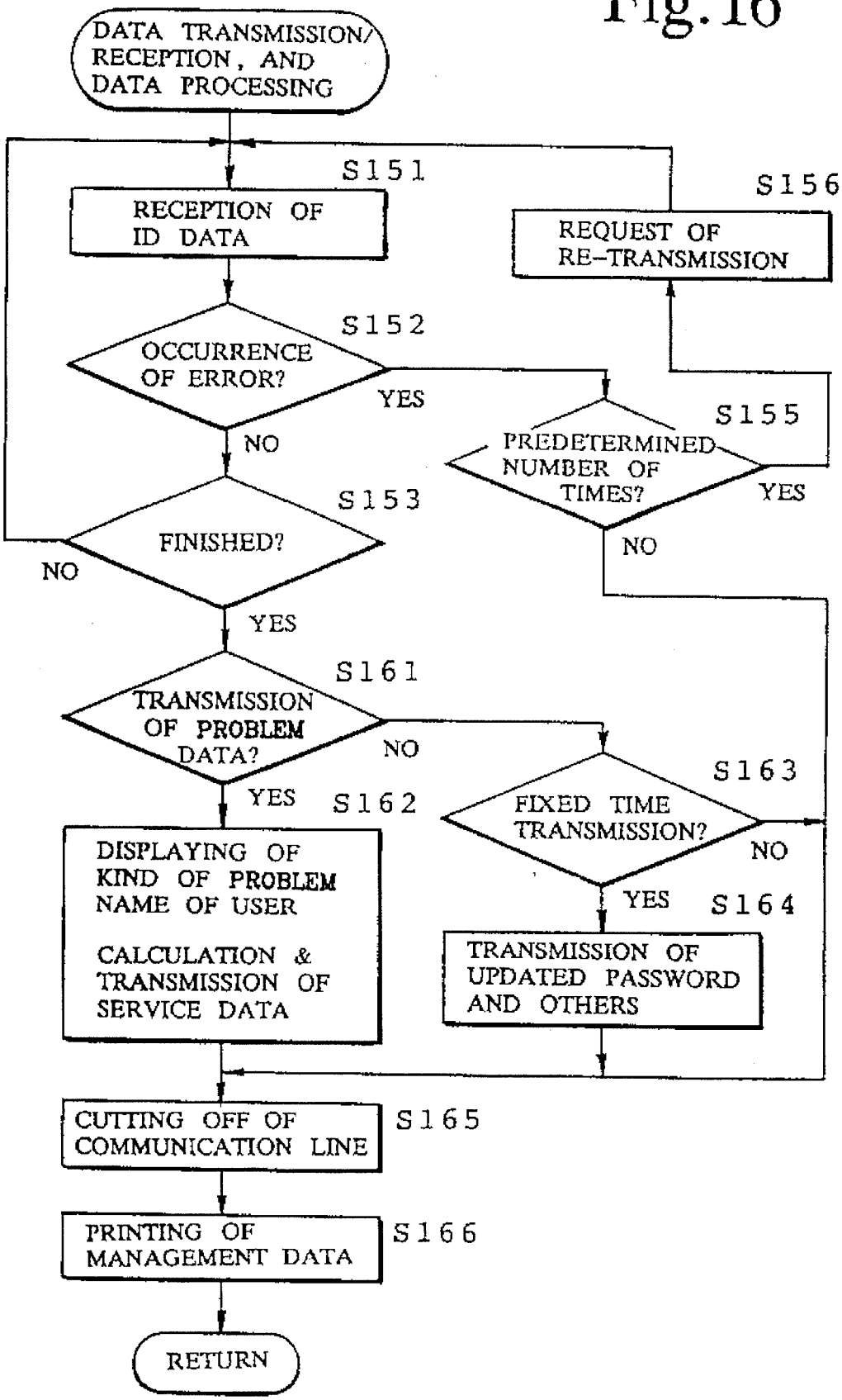
FIG. 16 is a flowchart for describing a data transmission/reception process executed under the interrupt process.

FIG. 16 is a flowchart for describing, in detail, the transmission and reception of data and its process both executed in the form of the interrupt process. When a message received by the modem 72 through the communication line is detected and an interrupt occurs in the CPU 91 of the management apparatus, the reception of a data terminal identification number (DTID) and other data is made between the CPU 91 and the data terminal 1 corresponding to the party called upon communication (Step S151).

It is next determined whether or not an error has occurred during the reception of data (Step S152). If the answer is negative in Step S152, it is then judged whether or not the reception of data has been finished (Step S153). If the answer is negative in Step S153, the routine procedure is returned to Step S151, where the process for receiving the data is continuously executed.

If the answer is affirmative in Step S153, it is then determined whether or not the communication about the data reception corresponds to that about the problem-data transmission (Step S161).

If the answer is affirmative in Step S161, the kind of problems and the name of a user are displayed on the display 92. Further, the scheduled time for arrival of the serviceman and other service data are computed based on the service schedule management data stored in the RAM 97 and the computed data are sent to the data terminal 1 (Step S162).

If the answer is negative in Step S161, it is then determined whether or not the communication corresponds to that about the fixed-time transmission (Step S163).

If the answer is affirmative in Step S163, a password for a copying machine 4 connected to the data terminal 1, in which the transmission of data has been performed at present, is updated and sent to the data terminal 1 (Step S164).

Since the data processing is completed in this way, a process for cutting off the communication line is executed (Step S165). Further, the management data are combined into a total for each item and month, and instructions (date and hour for call, parts to be carried by the serviceman, etc.) given to the serviceman are printed. Thereafter, the routine procedure is returned to the main routine.

If the answer is affirmative in Step S152, it is then determined whether or not the number of times at which the problem has occurred falls within a predetermined number of times (Step S155). If the answer is affirmative in Step S155, a data retransmission request is made to the data terminal 1 (Step S156). If the answer is negative in Step S155, the communication line is cut off (Steps S165 and S166).

According to the first example described above, the counting of the data about the problem developed during the problem reproduction test executed upon service working such as the repairing of the problem caused in the copying machine is prohibited. Thus, when the serviceman card is inserted into the copying machine prior to the service working of the serviceman to set the serviceman mode, the data about the problem is prohibited from being transmitted out of the copying machine.

As an alternative to the above process, the following process may be executed. That is, when the manual transmission switch is turned on to record information about the commencement of the service work of the serviceman, the data about the problem may be prohibited from being transmitted out of the copying machine until the elapse of a predetermined time interval necessary for the service work so that the counting of the problem data is not performed by the management apparatus. This process will be described below as a second embodiment.

The second embodiment differs from the first embodiment in the following points. That is, the data transmission/reception process (its detailed description refers to the flowchart shown in FIG. 12) of Step S67 in the communication line turning-on process described in the flowchart of FIG. 11(*a*), and the process (its detailed description refers to the flowchart of FIG. 13) about the problem transmission prohibiting flag in the processes executed by the CPU 11 of the data terminal, which have been described in accordance with the Step S42 in the flowchart of FIG. 9, are simply different from those executed in the second embodiment. Therefore, only the points of difference referred to above will be described below.

Figure 17:
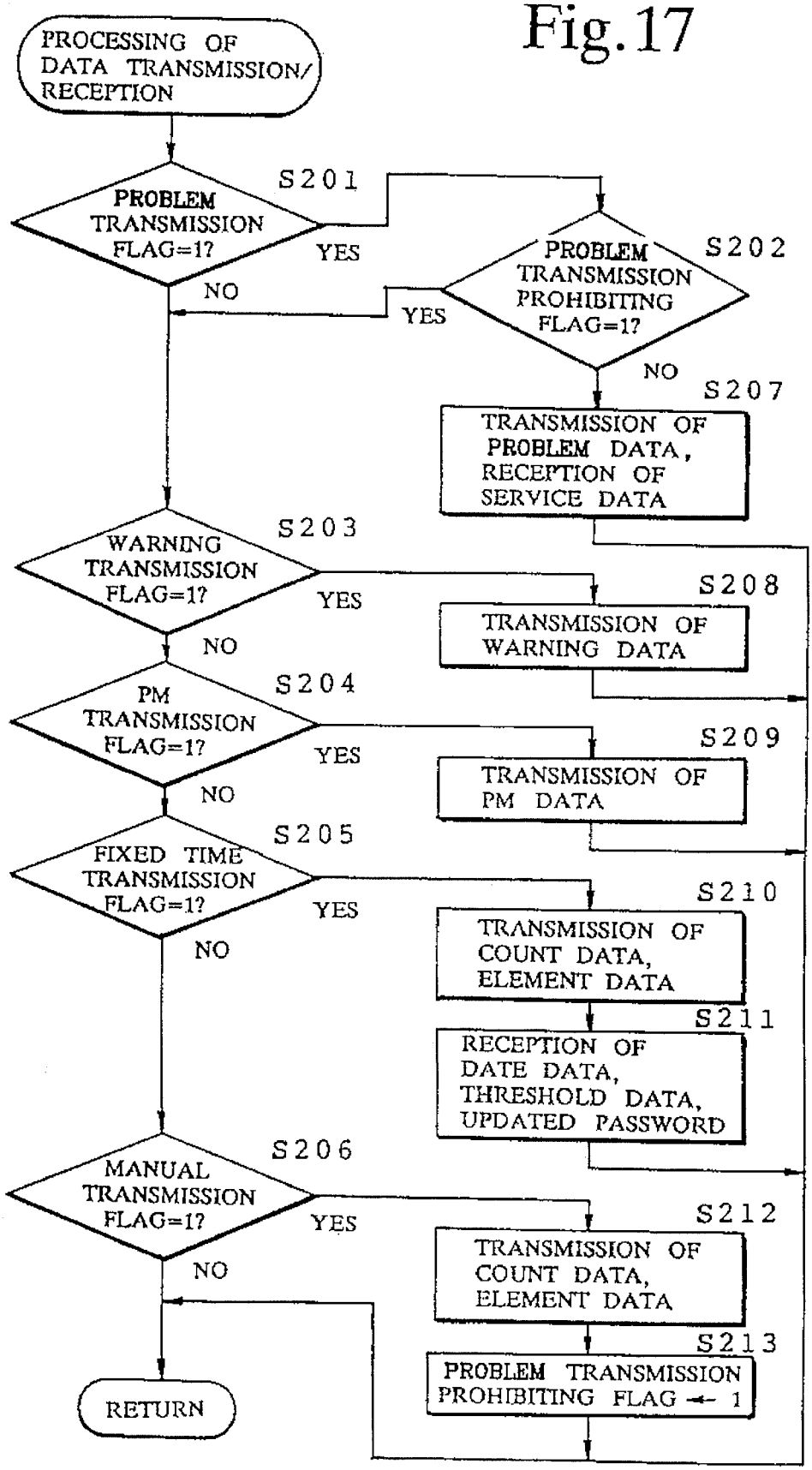
FIG. 17 is a flowchart for describing a second example of a problem-data transmission prohibiting process executed by the CPU of the data terminal.

A flowchart shown in FIG. 17 corresponds to the flowchart shown in FIG. 12, which is used in the first embodiment. The flowchart of FIG. 17 also shows particulars of a data transmission/reception process. The point of difference between the two flowcharts is as follows. In the first embodiment (see FIG. 12), when it is decided in Step S106 that the manual transmission has been made by the operation of the serviceman, the count data and the element data are transmitted (Step S112). Thereafter, the manual transmission counter is incremented by "+1" (Step S113). In the second embodiment (see FIG. 17), if it is decided in Step S206 that the manual transmission has been made by the operation of a serviceman, count data and element data are transmitted (Step S212). Thereafter, a problem transmission prohibiting flag is set to 1 (Step S213). That is, the second embodiment is constructed such that when it is decided that the manual transmission has been made, the problem transmission prohibiting flag is set to 1 to thereby prohibit the problem data from being transmitted.

Figure 18:
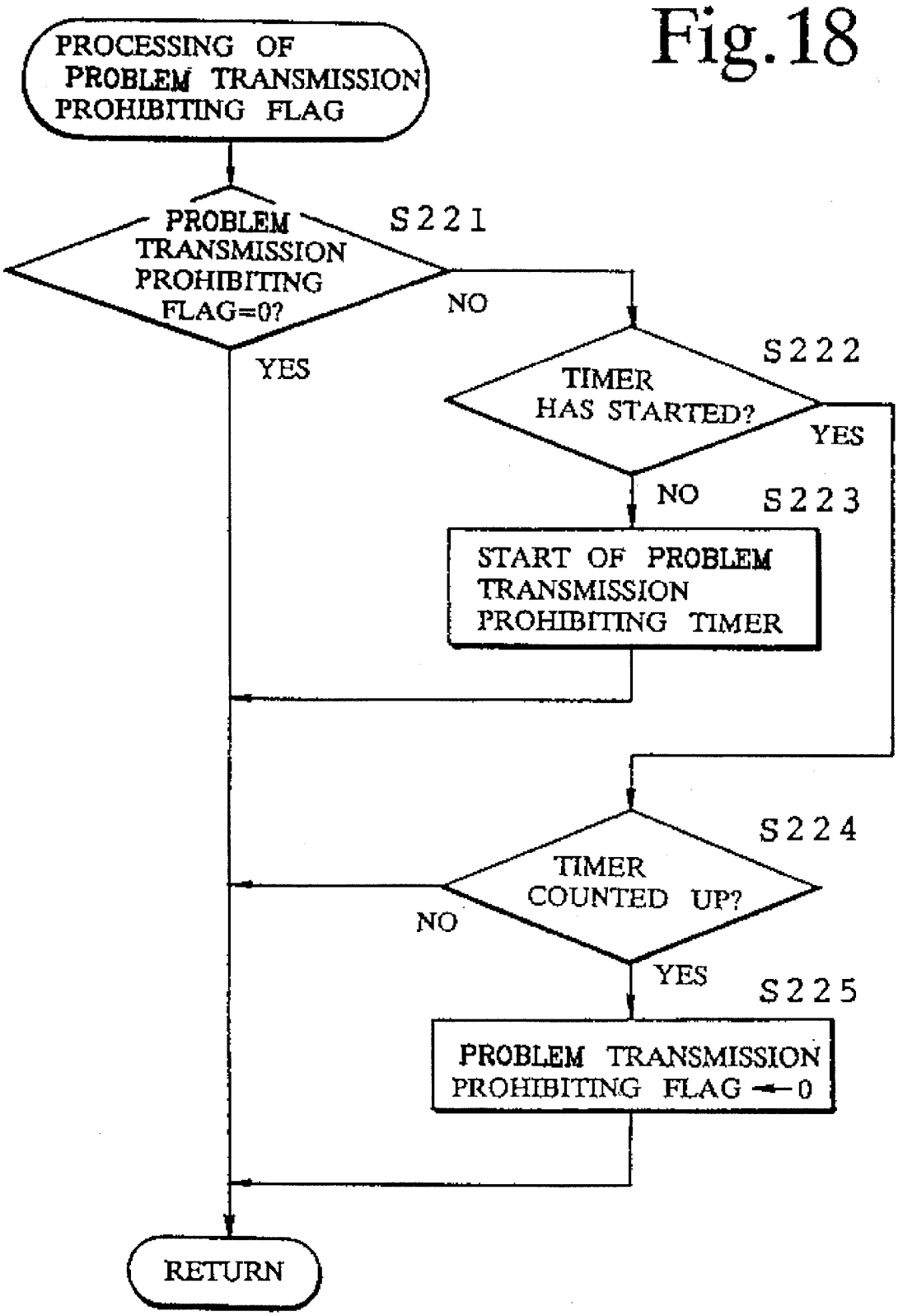
FIG. 18 is a flowchart for describing a second example of a problem transmission prohibiting flag process executed by the CPU of the data terminal.

Next, a process for resetting the problem transmission prohibiting flag will be described below. A flowchart shown in FIG. 18 corresponds to the flowchart of FIG. 13 employed in the first embodiment. The flowchart shown in FIG. 18 also shows particulars of the processing of the problem transmission prohibiting flag. It is first determined whether or not the problem transmission prohibiting flag has been reset to 0 (Step S221). If the answer is affirmative in Step S221, the routine procedure is returned to the main routine. On the other hand, if the answer is negative in Step S221, it is then determined whether or not a problem transmission prohibiting timer has started counting (Step S222). If the answer is negative in Step S222, the timer starts counting (Step S223).

If the answer is affirmative in Step S222, it is then determined whether or not the counting of the timer has been finished (Step S224). If the answer is affirmative in Step S224, the problem transmission prohibiting flag is reset to 0 (Step S225).

According to the above processing, when the manual transmission is made upon repairing the problem by the serviceman, the problem transmission prohibiting flag is set to 1 to thereby prohibit the problem-data transmission. After a predetermined time interval has elapsed, the problem transmission prohibiting flag is reset to realize the problem-data transmission.

It is needless to say that the present invention can be applied even to a system for effecting centralized management on various business machines such as a computer as well as a copying machine.

According to the present invention, as has been described above in detail, when a serviceman mode is set to a corresponding copying machine provided on the user side or when particular data is transmitted by manual operation upon starting service work, data about problems occurring during the service work, such as data about a problem developed during a problem reproduction test, i.e., the data about the problems which should not be counted on the management apparatus side, are no longer counted on the management apparatus side, thereby making it possible to accurately manage each copying machine. Further, the service station can avoid inconvenience such as a misunderstanding that a new problem has occurred in a copying machine provided on the user side due to the transmission of data about a problem data occurring during service work and the dispatch of a serviceman due to the misunderstanding.

Having now fully described the invention, it will be apparent to those skilled in the art that many changes and modifications can be made without departing from the spirit or scope of the invention as set forth herein.

What is claimed is:

1. An image forming apparatus connected to an information management apparatus through a communication line, said image forming apparatus including:

detecting means for detecting a problem in the image forming apparatus;

sending means for sending data indicating an occurrence of the problem to the information management apparatus when the problem is detected by said detecting means;

setting means for setting a mode in which the image forming apparatus is in a test operation state to repair the problem; and prohibiting means for prohibiting the data indicating an occurrence of a problem from being sent by said sending means while said mode is set by said setting means.

2. The image forming apparatus as claimed in claim 1, wherein said setting means is a card which sets said mode by the insertion thereof into the image forming apparatus.

3. The image forming apparatus as claimed in claim 1 further comprising a second sending means for sending data concerning the image forming apparatus to the information management apparatus by manual operation thereof and counting means for counting a number of times of the manual operation of said second sending means, wherein said setting means sets said mode when the manual operation of said-second sending means is executed odd-numbered times.

4. The image forming apparatus as claimed in claim 3, wherein said mode set by said setting means is cancelled when the manual operation of said second sending means is executed even-numbered times.

5. The image forming apparatus as claimed in claim 1 further comprising second sending means for sending data concerning the image forming apparatus to the information management apparatus by manual operation thereof and timing means for timing a predetermined time, wherein said setting means sets said mode when the manual operation of the second sending means is executed and cancels said mode when the predetermined time is timed by the timing means from the execution of the manual operation.

6. The image forming apparatus as claimed in claim 1, wherein said setting means includes a mode setting switch and said mode is set by operating the mode setting switch prior to repair of the apparatus.

7. The image forming apparatus as claimed in claim 1 further comprising inputting means for inputting an identification code, wherein said setting means sets said mode when the identification code is inputted by the inputting means prior to repair of the apparatus.

8. An image forming apparatus connected to an information management apparatus through a communication line, said image forming apparatus including:

detecting means for detecting a problem in the image forming apparatus;

first sending means for automatically sending data indicating an occurrence of the problem to the information management apparatus when the problem is detected by said detecting means;

second sending means for manually sending data concerning the image forming apparatus to the information management apparatus;

timing means for timing a predetermined time; and prohibiting means for prohibiting the data indicating an occurrence of a problem from being sent by said first sending means until the predetermined time is timed by said timing means after the data is sent by said second timing means.

9. A management system for managing maintenance information of an image forming apparatus by an information management apparatus through a communication line, comprising:

detecting means for detecting a problem in the image forming apparatus;

sending means for sending data indicating an occurrence of the problem to the information management apparatus when the problem is detected by said detecting means;

setting means provided for setting a mode in which the image forming apparatus is in a test operation state to repair the problem;

counting means for counting the data indicating an occurrence of a problem sent to the information management apparatus unit from said sending means; and prohibiting means for prohibiting said counting means from counting the data indicating an occurrence of a problem while said mode is set by the setting means.

10. The management system as claimed in claim 9 further comprising a second sending means for sending data concerning the image forming apparatus to the information management apparatus by manual operation thereof and means for counting a number of times of the manual operation of said second sending means, wherein said setting means sets said mode when the manual operation of said sending means is executed odd-numbered times.

11. The management system as claimed in claim 10, wherein said mode set by said setting means is cancelled when the manual operation of said second sending means is executed even-numbered times.

* * * * *